US008416043B2

(12) United States Patent
Ikriannikov

(10) Patent No.: US 8,416,043 B2
(45) Date of Patent: Apr. 9, 2013

(54) POWDER CORE MATERIAL COUPLED INDUCTORS AND ASSOCIATED METHODS

(75) Inventor: Alexandr Ikriannikov, Castro Valley, CA (US)

(73) Assignee: Volterra Semiconductor Corporation, Fremont, CA (US)

( * ) Notice: Subject to any disclaimer, the term of this patent is extended or adjusted under 35 U.S.C. 154(b) by 0 days.

(21) Appl. No.: 13/024,280

(22) Filed: Feb. 9, 2011

(65) Prior Publication Data

US 2011/0286144 A1 Nov. 24, 2011

Related U.S. Application Data

(63) Continuation-in-part of application No. 12/786,301, filed on May 24, 2010.

(51) Int. Cl.

| | |
|---|---|
| ***H01F 27/02*** | (2006.01) |
| ***H01F 27/29*** | (2006.01) |
| ***H01F 5/00*** | (2006.01) |
| ***H01F 27/28*** | (2006.01) |
| ***H01F 27/24*** | (2006.01) |

(52) U.S. Cl.

USPC ..... 336/83; 336/192; 336/200; 336/222; 336/232; 336/233

(58) Field of Classification Search ..... 336/83, 336/192, 200, 222, 232

See application file for complete search history.

(56) References Cited

U.S. PATENT DOCUMENTS

| | | | |
|---|---|---|---|
| 3,448,421 | A | 6/1969 | Berg et al. |
| 3,574,685 | A | 4/1971 | Haines |
| 4,543,554 | A | 9/1985 | Muellenheim et al. |
| 4,636,752 | A | 1/1987 | Saito |
| 5,023,578 | A | 6/1991 | Keneko et al. |
| 5,123,989 | A | 6/1992 | Horiishi et al. |
| 5,353,001 | A | 10/1994 | Meinel et al. |
| 5,469,334 | A | 11/1995 | Balakrishnan |

(Continued)

FOREIGN PATENT DOCUMENTS

| | | |
|---|---|---|
| EP | 1 632 964 | 3/2006 |
| EP | 1 833 165 | 9/2007 |

(Continued)

OTHER PUBLICATIONS

Chandrasekaran , S. et al., "Integrated Magnetics for Interleaved DC-DC Boost for Fuel Cell Powered Vehicles," 35th Annual IEEE Power Electronics Specialists Conferences, 356-61 (2004).

(Continued)

*Primary Examiner* — Mohamad Musleh
*Assistant Examiner* — Tsz Chan
(74) *Attorney, Agent, or Firm* — Lathrop & Gage LLP

(57) ABSTRACT

A multi-phase coupled inductor includes a powder core material magnetic core and first, second, third, and fourth terminals. The coupled inductor further includes a first winding at least partially embedded in the core and a second winding at least partially embedded in the core. The first winding is electrically coupled between the first and second terminals, and the second winding electrically is coupled between the third and fourth terminals. The second winding is at least partially physically separated from the first winding within the magnetic core. The multi-phase coupled inductor is, for example, used in a power supply.

4 Claims, 17 Drawing Sheets

U.S. PATENT DOCUMENTS

| | | | | |
|---|---|---|---|---|
| 5,565,837 | A | 10/1996 | Godek et al. | |
| 5,568,111 | A | 10/1996 | Metsler | |
| 5,574,420 | A | 11/1996 | Roy et al. | |
| 5,631,822 | A | 5/1997 | Siberkleit et al. | |
| 5,939,966 | A | 8/1999 | Shin'Ei | |
| 6,060,977 | A | 5/2000 | Yamamoto et al. | |
| 6,114,932 | A | 9/2000 | Wester et al. | |
| 6,198,375 | B1 | 3/2001 | Shafer | |
| 6,204,744 | B1 | 3/2001 | Shafer et al. | |
| 6,342,778 | B1 | 1/2002 | Catalano et al. | |
| 6,362,986 | B1 | 3/2002 | Schultz et al. | |
| 6,377,155 | B1 | 4/2002 | Allen et al. | |
| 6,388,896 | B1 | 5/2002 | Cuk | |
| 6,420,953 | B1 | 7/2002 | Dadafshar | |
| 6,449,829 | B1 | 9/2002 | Shafer | |
| 6,460,244 | B1 | 10/2002 | Shafer et al. | |
| 6,549,111 | B1 | 4/2003 | De Graaf et al. | |
| 6,578,253 | B1 | 6/2003 | Herbert | |
| 6,765,468 | B2 | 7/2004 | Chen et al. | |
| 6,791,444 | B1 * | 9/2004 | Masuda et al. | 336/83 |
| 6,867,678 | B2 | 3/2005 | Yang | |
| 6,980,077 | B1 | 12/2005 | Chandrasekaran et al. | |
| 7,034,645 | B2 | 4/2006 | Shafer et al. | |
| 7,187,263 | B2 | 3/2007 | Vinciarelli | |
| 7,259,648 | B2 * | 8/2007 | Matsutani et al. | 336/200 |
| 7,280,025 | B2 | 10/2007 | Sano | |
| 7,292,128 | B2 * | 11/2007 | Hanley | 336/234 |
| 7,425,883 | B2 | 9/2008 | Matsutani et al. | |
| 7,498,920 | B2 | 3/2009 | Sullivan et al. | |
| 7,525,406 | B1 | 4/2009 | Cheng | |
| 2002/0067234 | A1 | 6/2002 | Kung | |
| 2002/0093413 | A1 | 7/2002 | Shin'ei | |
| 2004/0017276 | A1 | 1/2004 | Chen et al. | |
| 2005/0024179 | A1 | 2/2005 | Chandrasekaran et al. | |
| 2005/0128040 | A1 | 6/2005 | Gray et al. | |
| 2006/0049907 | A1 | 3/2006 | Liu | |
| 2006/0145804 | A1 | 7/2006 | Matsutani et al. | |
| 2006/0158297 | A1 | 7/2006 | Sutardja | |
| 2008/0012674 | A1 | 1/2008 | Sano et al. | |
| 2008/0024259 | A1 | 1/2008 | Chandrasekaran et al. | |
| 2008/0136576 | A1 | 6/2008 | Emmons et al. | |
| 2008/0150666 | A1 | 6/2008 | Chandrasekaran et al. | |
| 2009/0179723 | A1 | 7/2009 | Ikriannikov et al. | |
| 2009/0231081 | A1 | 9/2009 | Ikriannikov et al. | |
| 2009/0237197 | A1 | 9/2009 | Ikriannikov et al. | |
| 2010/0007457 | A1 | 1/2010 | Yan et al. | |

FOREIGN PATENT DOCUMENTS

| | | |
|---|---|---|
| JP | 2000-164431 | 6/2000 |
| JP | 2005310865 | 11/2005 |
| WO | WO 2006/026674 | 3/2006 |
| WO | W02009059069 A2 | 5/2009 |

OTHER PUBLICATIONS

Cooper Bussmann, "Product Data Sheet for Low Profile Inductor (Surface Mount)" retrieved from http://www.angliac.com, May 2003.

Micrometals, Inc., Composite Cores parts listing, 1 page, accessed via the internet at http://www.micrometals.com/pcparts/ccore.html on Dec. 18, 2007.

Panasonic, Power Choke Coil, 2 pages, Jan. 2008.

Pulse, SMT Power Inductors datasheet, 2 pages, Nov. 2007.

Pulse Product News Press Release dated Nov. 25, 2008.

Pulse, SMT Power Inductors Power Beads—PA0766NL Series; pp. 53-55; Mar. 2006.

TSC Pyroferric Composite Toroid datasheet, 1 page, accessed via the internet at http://www.tscinternational.net/comptoroidprint.pdf on Dec. 18, 2007.

Vishay, Low Profile, High Current IHLP Inductor, 3 pages, Jan. 21, 2009.

Vitec, Dual High Frequency High Power Inductor, AF4390A data sheet; date unknown. Applicants do not concede this reference as prior art.

Office Action issued in U.S. Appl. No. 12/786,301, Jun. 22, 2012.

International Search Report and Written Opinion issued in PCT Patent Application PCT/US11/37751, Aug. 21, 2012.

* cited by examiner

POWDER CORE MATERIAL COUPLED INDUCTORS AND ASSOCIATED METHODS

RELATED APPLICATIONS

This application is a continuation in part of U.S. patent application Ser. No. 12/786,301 filed May 24, 2010, which is incorporated herein by reference.

BACKGROUND

Switching DC-to-DC converters having a multi-phase coupled-inductor topology are described in U.S. Pat. No. 6,362,986 to Schultz et al., the disclosure of which is incorporated herein by reference. These converters have advantages, including reduced ripple current in the inductors and the switches, which enables reduced per-phase inductance and/or reduced switching frequency over converters having conventional multi-phase DC-to-DC converter topologies. As a result, DC-to-DC converters with magnetically coupled inductors achieve a superior transient response without an efficiency penalty when compared to conventional multiphase topologies. This allows a significant reduction in output capacitance resulting in smaller, lower cost solutions.

Various coupled inductors have been developed for use in multi-phase DC-to-DC converters applications. Such prior art coupled inductors typically include two or more windings wound through one or more passageways in a magnetic core. Examples of prior art coupled inductors may be found in U.S. Pat. No. 7,498,920 to Sullivan et al., the disclosure of which is incorporated herein by reference.

SUMMARY

In an embodiment, a coupled inductor includes a magnetic core formed of a powder magnetic material and first, second, third, and fourth terminals. The coupled inductor further includes a first and a second winding, each at least partially embedded in the magnetic core. The first winding is electrically coupled between the first and second terminals, and the second winding is electrically coupled between the third and fourth terminals. The second winding is at least partially physically separated from the first winding within the magnetic core.

In an embodiment, a power supply includes a printed circuit board, a coupled inductor affixed to the printed circuit board, and a first and a second switching circuit affixed to the printed circuit board. The coupled inductor includes a magnetic core formed of a powder magnetic material and first, second, third, and fourth terminals. The coupled inductor further includes a first winding at least partially embedded in the magnetic core and a second winding at least partially embedded in the magnetic core. The first winding is electrically connected between the first and second terminals, and the second winding is electrically connected between the third and fourth terminals. The second winding is at least partially physically separated from the first winding within the magnetic core. The first switching circuit is electrically coupled to the first terminal and configured to switch the first terminal between at least two different voltage levels. The second switching circuit is electrically coupled to the third terminal and configured to switch the third terminal between at least two different voltage levels. The second and fourth terminals are electrically connected together.

In an embodiment, a method for forming a coupled inductor includes (1) positioning a plurality of windings such that each winding of the plurality of windings is at least partially physically separated from each other winding of the plurality of windings, (2) forming a powder magnetic material at least partially around the plurality of windings, and (3) curing a binder of the powder magnetic material.

In an embodiment, a method for forming a coupled inductor includes (1) positioning a plurality of windings in a mold such that each winding of the plurality of windings is at least partially physically separated from each other winding of the plurality of windings, (2) disposed a powder magnetic material in the mold, and (3) curing a binder of the powder magnetic material.

DETAILED DESCRIPTION OF THE EMBODIMENTS

Figure 1:
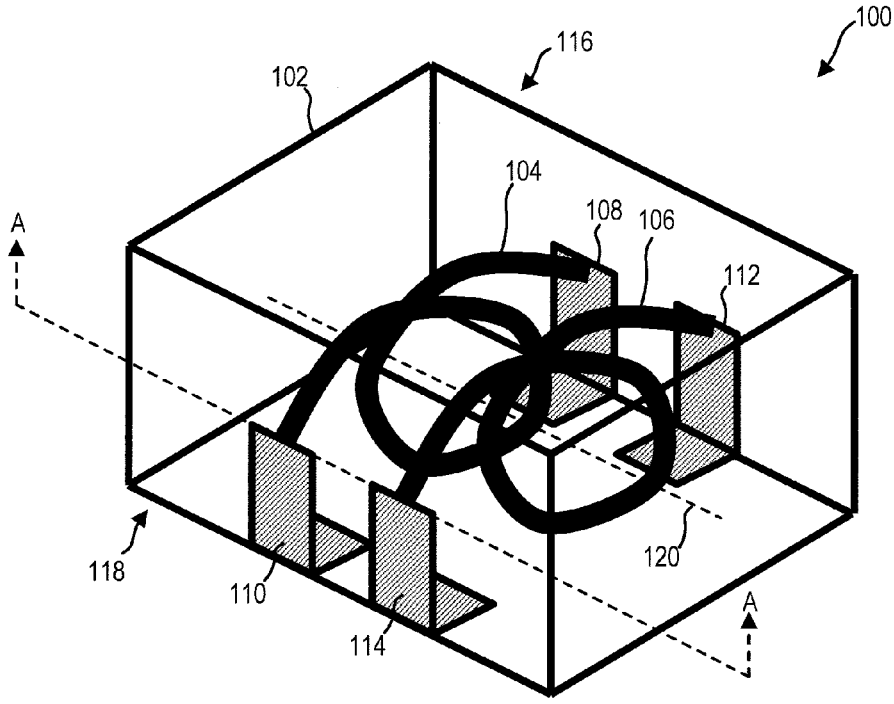
FIG. 1 shows a perspective view and FIG. 2 shows a top cross sectional view of a two phase coupled inductor, according to an embodiment.

Disclosed herein, among other things, are coupled inductors that significantly advance the state of the art. In contrast to prior art coupled inductors, the coupled inductors disclosed herein include two or more windings at least partially embedded in a magnetic core formed of a powder magnetic material, such as powdered iron within a binder. Such coupled inductors may have one or more desirable features, as discussed below. It the following disclosure, specific instances of an item may be referred to by use of a numeral in parentheses (e.g., switching node 416(1)) while numerals without parentheses refer to any such item (e.g., switching nodes 416). For purposes of illustrative clarity, certain elements in the drawings may not be drawn to scale.

Figure 2:
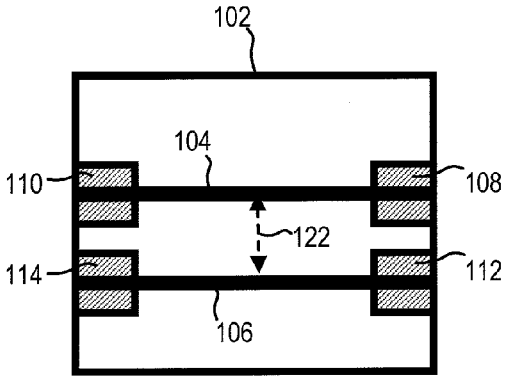

FIG. 1 shows one example of a coupled inductor including two or more windings at least partially embedded in a magnetic core formed of a powder magnetic material. Specifically, FIG. 1 shows a perspective view of coupled inductor 100, and FIG. 2 shows a cross sectional view of coupled inductor 100 taken along line A-A of FIG. 1. Inductor 100 includes a magnetic core 102, windings 104, 106, and electrical terminals 108, 110, 112, 114. Core 102, which is shown as transparent in FIG. 1, includes a first side 116 and an opposite second side 118. Core 102 is formed of a powder magnetic material, such as powdered iron within a binder, and provides a path for magnetic flux to magnetically couple together windings 104, 106. Windings 104, 106 each form at least one turn and are at least partially embedded in core 102. Typically, windings 104, 106 are mostly or completely embedded in core 102 to promote strong magnetic coupling between windings 104, 106 and to promote mechanical robustness of coupled inductor 100.

Figure 3:
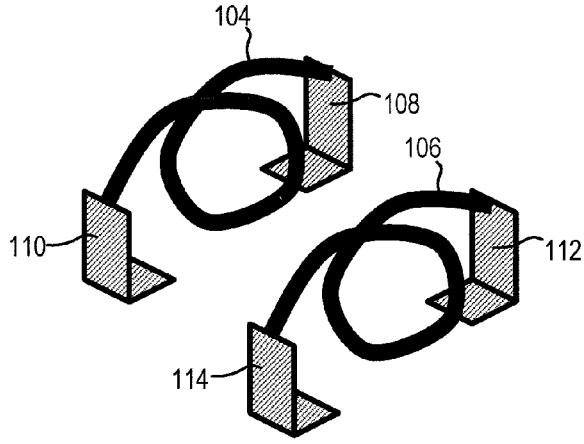
FIG. 3 shows a perspective view of the windings of the coupled inductor of FIGS. 1 and 2 separated from a magnetic core of the inductor.

Winding 104 is electrically coupled between terminals 108, 110, and winding 106 is electrically coupled between terminals 112, 114. Thus, terminals 108, 110 provide electrical interface to winding 104, and terminals 112, 114 provide electrical interface to winding 106. Terminals 108, 112 are disposed proximate to first side 116, and terminals 110, 114 are disposed proximate to second side 118. Terminals 108, 110, 112, 114 may be in form of solder tabs as shown in FIGS. 1-3 such that coupled inductor 100 is suitable for surface mount soldering to a printed circuit board (PCB). Such solder tabs, for example, are discrete components connected (e.g., welded or soldered) to the windings. However, the solder tabs could alternately be formed from the windings themselves, such as by pressing winding ends to form solder tabs. Terminals 108, 110, 112, 114 may also have forms other than solder tabs, such as through-hole pins for soldering to plated PCB through holes.

In certain embodiments, windings 104, 106 are aligned such that they form at least one turn along a common axis 120, which promotes strong magnetic coupling between windings 104, 106. Common axis 120 is, for example, disposed in a horizontal plane of core 102, as shown in FIG. 1. Windings 104, 106 are, for example, formed of wire or foil. FIG. 3 shows a perspective view of windings 104, 106 separate from core 102.

Windings 104, 106 are at least partially separated from each other within core 102 to provide a path for leakage magnetic flux and thereby create leakage inductance when coupled inductor 100 is connected to a circuit. As it is known in the art, coupled inductors must have a sufficiently large leakage inductance in DC-to-DC converter applications to limit ripple current magnitude. In the example of FIGS. 1 and 2, windings 104, 106 are horizontally separated from each other and are completely physically separated from each other by a separation distance 122 (see FIG. 2). Leakage inductance is proportional to separation 122 between windings 104, 106, and leakage inductance can therefore be varied during the design of coupled inductor 100 by varying separation distance 122. Leakage inductance is also inversely proportional to a magnetic permeability of the powder magnetic material of core 102, and leakage inductance can thus be adjusted during the design of coupled inductor 100 by varying the composition of the material forming core 102. In certain embodiments, at least some of the powder core magnetic material between windings 104, 106 has a different composition, such as a different magnetic characteristic, than the power core magnetic material forming other portions of core 102. Such feature may be used, for example, to control separation of windings 104, 106 during core 102's manufacturing, and/or to control magnetic permeability of core 102 in an area between windings 104, 106.

Figure 4:
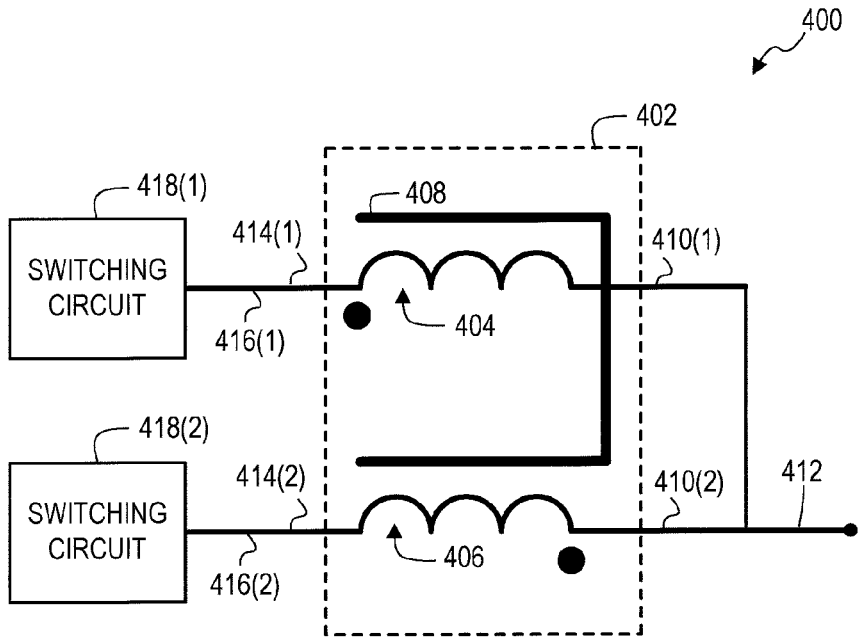
FIG. 4 shows a schematic of a DC-to-DC converter.

As known in the art, coupled inductor windings must be inversely magnetically coupled to realize the advantages discussed above that result from using coupled inductors, instead of multiple discrete inductors, in a multiphase DC-to-DC converter. Inverse magnetic coupling in a two phase DC-to-DC converter application can be appreciated with reference to FIG. 4, which shows a schematic of a two phase DC-to-DC converter 400. DC-to-DC converter 400 includes a coupled inductor 402, having two windings 404, 406, and a magnetic core 408 magnetically coupling the windings 404, 406. A first end 410 of each winding 404, 406 electrically couples to a common node 412, and a second end 414 of each winding 404, 406 electrically couples to a respective switching node 416. A respective switching circuit 418 is also electrically coupled to each switching node 416. Each switching circuit 418 switches its respective second end 414 between at least two different voltage levels. DC-to-DC converter 400, for example, may be configured as a buck converter where switching circuits 418 switch their respective second end 414 between an input voltage and ground, and common node 412 is an output node. In another exemplary embodiment, DC-to-DC converter 400 is configured as a boost converter, where each switching circuit 418 switches its second end 414 between an output node and ground, and common node 412 is an input node.

Coupled inductor 402 is configured such at it has inverse magnetic coupling between windings 404, 406. As a result of such inverse magnetic coupling, a current flowing through winding 404 from switching node 416(1) to common node 412 induces a current flowing through winding 406 from switching node 416(2) to common node 412. Similarly, a current flowing through winding 406 from switching node 416(2) to common node 412 induces a current in winding 404 flowing from switching node 416(1) to common node 412, because of the inverse coupling.

In coupled inductor 100 of FIGS. 1 and 2, windings 104, 106 are configured in core 102 such that a current flowing through winding 104 from first terminal 108 to second terminal 110 induces a current flowing through winding 106 from fourth terminal 114 to third terminal 112. As result, inverse coupling is achieved in coupled inductor 100 in DC-to-DC converter applications when either first and fourth terminals 108, 114 or second and third terminals 110, 112 are connected to respective switching nodes. Accordingly, the two terminals of coupled inductor 100 connected to switching nodes in DC-to-DC converter applications must each be on opposite sides of core 102 to realize inverse magnetic coupling.

Figure 5:
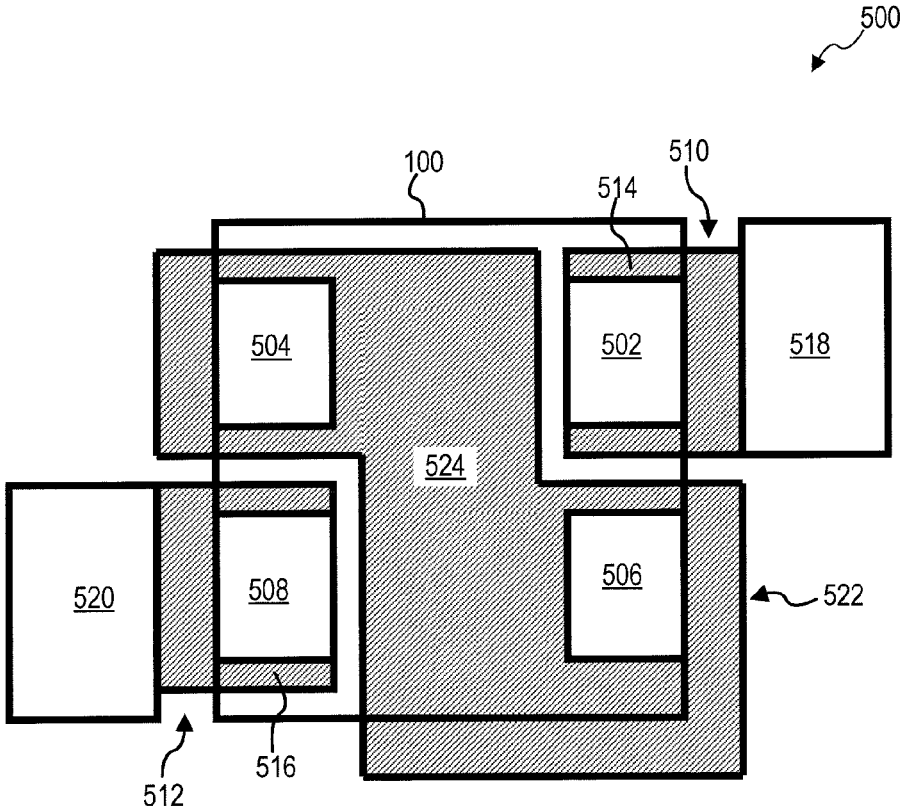
FIG. 5 shows one printed circuit board layout that may be used with certain embodiments of the coupled inductor of FIGS. 1 and 2 in a DC-to-DC converter application.

FIG. 5 shows one PCB layout 500 for use with certain embodiments of coupled inductor 100 in a DC-to-DC converter application. Layout 500 includes pads 502, 504, 506, 508 for respectively coupling to terminals 108, 110, 112, 114 of coupled inductor 100. Pads 502, 508 are respectively coupled to switching nodes 510 and 512 via conductive traces 514, 516, and switching circuits 518, 520 are respectively coupled to switching nodes 510 and 512 via conductive traces 514, 516. Pads 504, 506 connect to a common node 522 via conductive trace 524. Only the outline of coupled inductor 100 is shown in FIG. 5 to show details of layout 500. In certain embodiments, layout 500 forms part of a buck converter where common node 522 is an output node and switching circuits 518, 520 respectively switch switching nodes 510, 512 between an input voltage and ground.

As discussed above, terminals of coupled inductor 100 that are connected to switching nodes are disposed on opposite sides of core 102 to achieve inverse magnetic coupling. Thus, switching node pads 502, 508 are also disposed on opposite sides of coupled inductor 100. Switching circuits 518, 520 are also disposed on opposite sides of coupled inductor 100 in layout 500 because, as know in the art, switching circuits are preferably located near their respective inductor terminals for efficient and reliable DC-to-DC converter operation.

Figure 6:
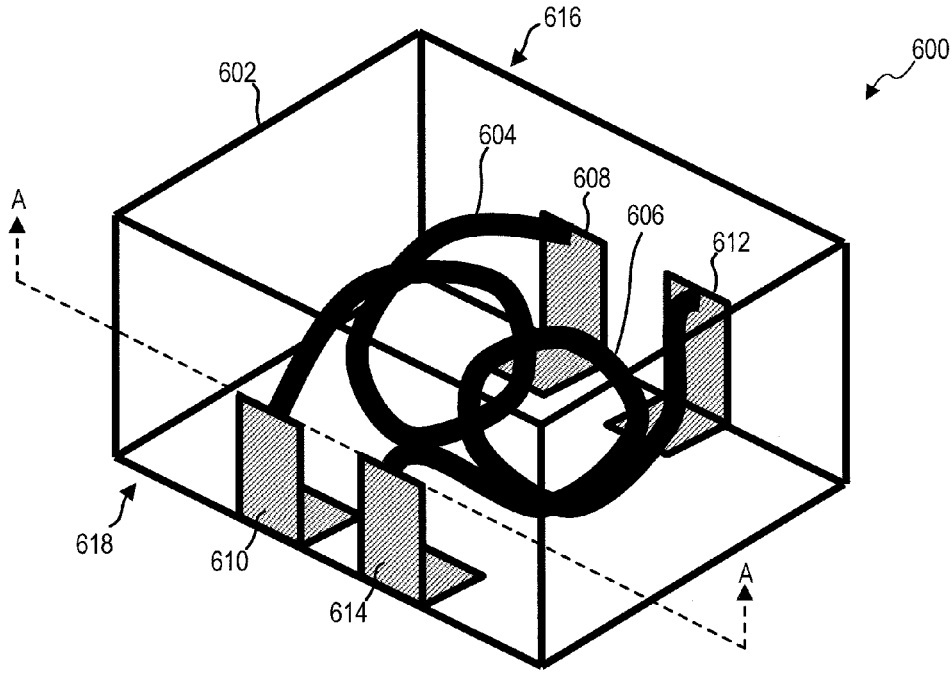
FIG. 6 shows a perspective view and FIG. 7 shows a top cross sectional view of another two phase coupled inductor, according to an embodiment.
Figure 7:
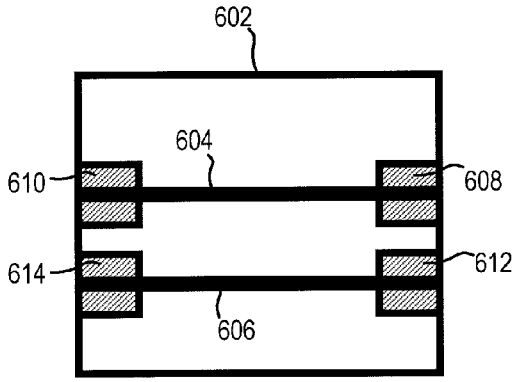
Figure 8:
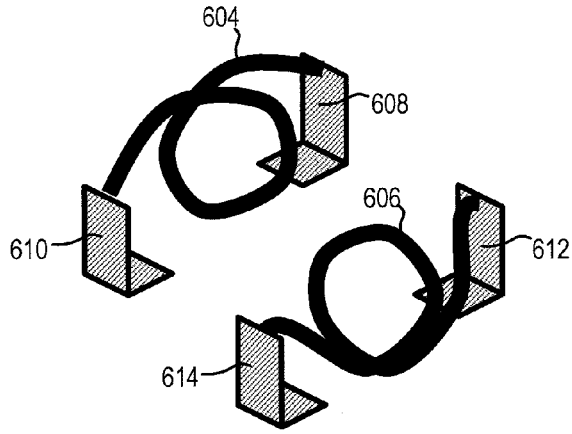
FIG. 8 shows a perspective view of the windings of the coupled inductor of FIGS. 6 and 7 separated from a magnetic core of the inductor.

FIG. 6 shows a perspective view of another coupled inductor 600, and FIG. 7 shows a cross sectional view of coupled inductor 600 taken along line A-A of FIG. 6. Coupled inductor 600 is similar to coupled inductor 100 of FIG. 1 but has a different winding configuration than coupled inductor 100. Coupled inductor 600 includes a magnetic core 602 (shown as transparent in FIG. 6) formed of a powder magnetic material, such as powdered iron within a binder, windings 604, 606, and electrical terminals 608, 610, 612, 614. Terminals 608, 612 are disposed proximate to a first side 616 of core 602, and terminals 610, 614 are disposed proximate to an opposite second side 618 of core 602. Winding 604 is electrically coupled between terminals 608, 610, and winding 606 is electrically coupled between terminals 612, 614. FIG. 8 shows a perspective view of windings 604, 606 separated from core 602.

Figure 9:
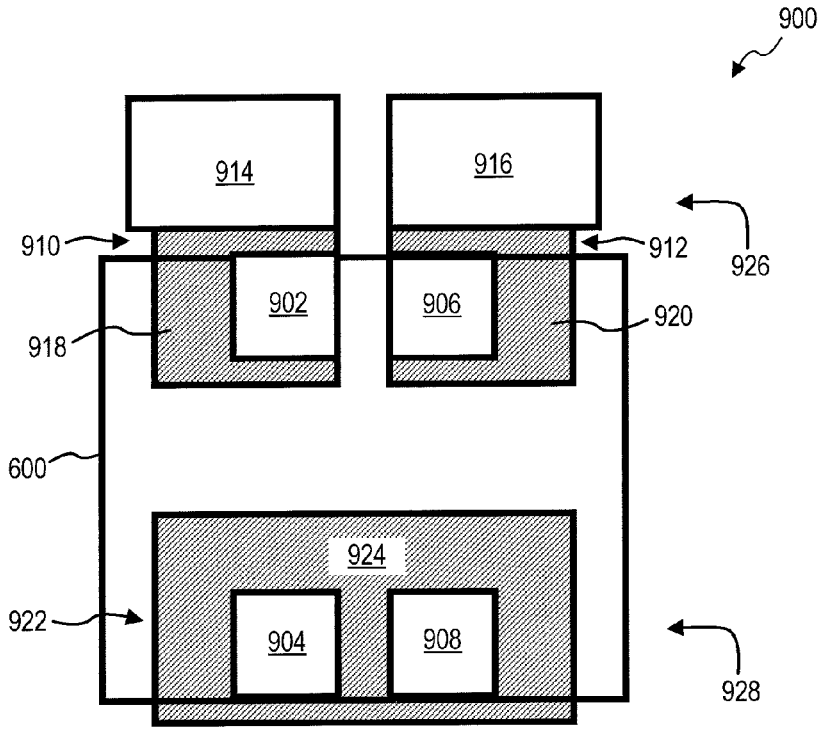
FIG. 9 shows one printed circuit board layout that may be used with certain embodiments of the coupled inductor of FIGS. 6 and 7 in a DC-to-DC converter application.

Windings 604, 606 are configured in core 602 such that an electric current flowing through winding 604 from a first terminal 608 to a second terminal 610 induces an electric current in winding 606 flowing from third terminal 612 to fourth terminal 614. Accordingly, in contrast to coupled inductor 100 of FIG. 1, inverse magnetic coupling is achieved with coupled inductor 600 when terminals on a same side of core 602 are connected to respective switching nodes. For example, FIG. 9 shows one PCB layout 900, which may be used with certain embodiments of coupled inductor 600 in a DC-to-DC converter application. Only the outline of coupled inductor 600 is shown in FIG. 9 to show details of layout 900. Layout 900 includes pads 902, 904, 906, 908 for respectively electrically coupling to terminals 608, 610, 612, 614 of coupled inductor 600. Each of pads 902, 906 electrically couples to a respective switching node 910, 912 and a respective switching circuit 914, 916 via a respective conductive trace 918, 920. Each of pads 904, 908 electrically couples to a common node 922 via a conductive trace 924. In certain embodiments, layout 900 forms part of a buck converter where common node 922 is an output node, and switching circuits 914, 916 respectively switch switching nodes 910, 912 between an input voltage and ground.

Due to inverse magnetic coupling being achieved when terminals on a common side of core 602 are electrically coupled to respective switching nodes, each of switching pads 902, 906 are disposed on a common side 926 of coupled inductor 600 in layout 900. Such feature allows each switching circuit 914, 916 to also be disposed on common side 926, which, for example, promotes ease of PCB layout and may enable use of a common heat sink for the one or more switching devices (e.g., transistors) of each switching circuit 914, 916. Additionally, each of common node pads 904, 908 are also disposed on a common side 928 in layout 900, thereby enabling common node trace 924 to be short and wide, which promotes low impedance and ease of PCB layout. Accordingly, the winding configuration of coupled inductor 600 may be preferable to that of coupled inductor 100 in certain applications.

Figure 10:
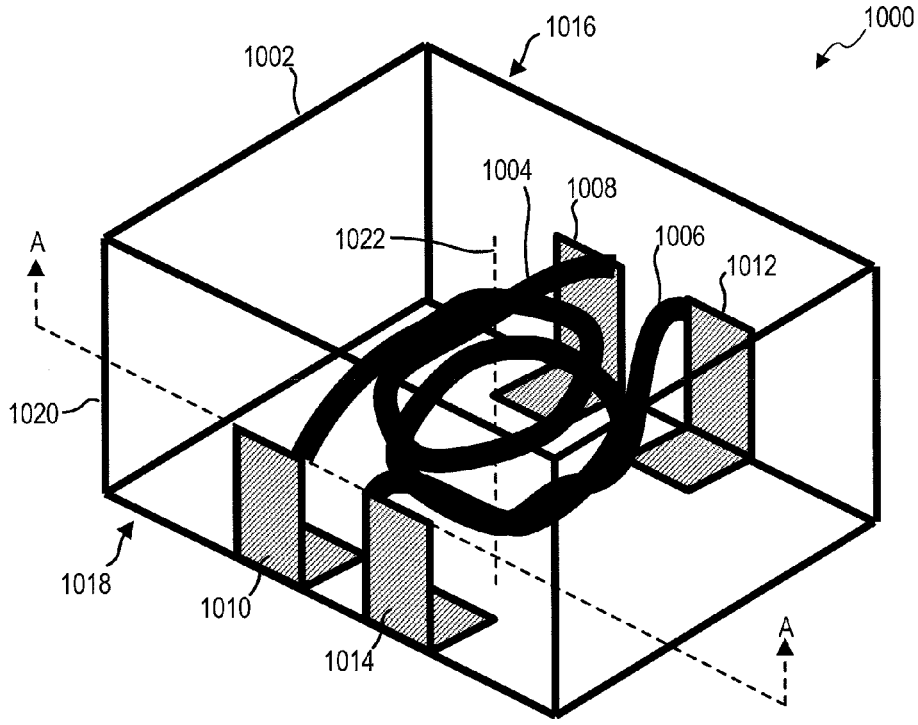
FIG. 10 shows a perspective view and FIG. 11 shows a top cross sectional view of another two phase coupled inductor, according to an embodiment.
Figure 11:
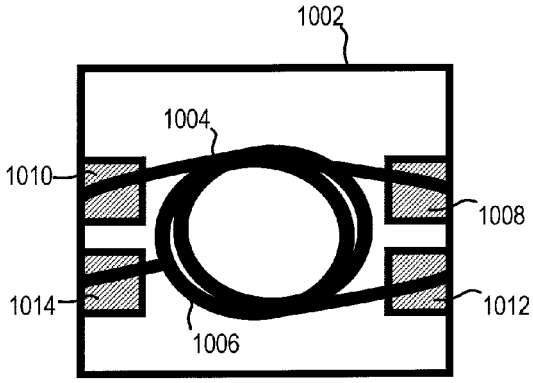
Figure 12:
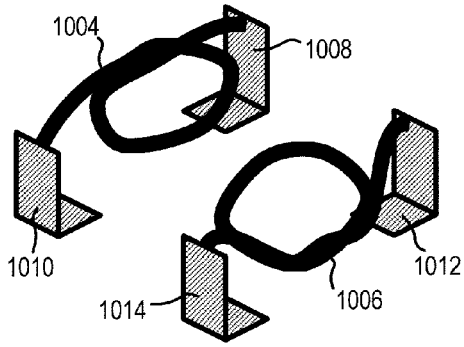
FIG. 12 shows a perspective view of the windings of the coupled inductor of FIGS. 10 and 11 separated from a magnetic core of the inductor.

FIG. 10 shows perspective view of another coupled inductor 1000, which is similar to coupled inductor 100, but has a different winding configuration. Coupled inductor 1000 includes a core 1002, shown as transparent in FIG. 10, formed of a powder magnetic material, such as powdered iron within a binder. Coupled inductor 1000 further includes windings 1004, 1006 at least partially embedded in core 1002 and electrical terminals 1008, 1010, 1012, 1014. Winding 1004 is electrically coupled between terminals 1008, 1010, and winding 1006 is electrically coupled between terminals 1012, 1014. Terminals 1008, 1012 are disposed proximate to a first side 1016 of core 1002, and terminals 1010, 1014 are disposed proximate to a second side 1018 of core 1002. FIG. 11 shows a cross sectional view of coupled inductor 1000 taken along line A-A of FIG. 10, and FIG. 12 shows a perspective view of windings 1004, 1006 separated from core 1002.

In contrast to coupled inductors 100 and 600 of FIGS. 1 and 6 respectively, windings 1004, 1006 are vertically displaced from each other in core 1002—that is, windings 1004, 1006 are displaced from each other along a vertical axis 1020. In certain embodiments, windings 1004, 1006 form at least one turn around a common axis 1022 to promote strong magnetic coupling between windings 1004, 1006. Axis 1022 is, for example, disposed in a vertical plane in core 1002 or parallel to vertical axis 1020, as shown in FIG. 10. Similar to coupled inductors 100 and 600, leakage inductance of coupled inductor 1000 when installed in a circuit is proportional to physical separation between windings 1004, 1006. Windings 1004, 1006 are configured in core 1002 such that a current flowing through winding 1004 from first terminal 1008 to second terminal 1010 induces a current through winding 1006 from third terminal 1012 to fourth terminal 1014. Thus, inverse magnetic coupling is achieved with coupled inductor 1000 in DC-to-DC converter applications when either terminals 1008, 1012 or 1010, 1014 are electrically coupled to respective switching nodes. Accordingly, certain embodiments of coupled inductor 1000 can be used with layout 900 of FIG. 9.

Figure 13:
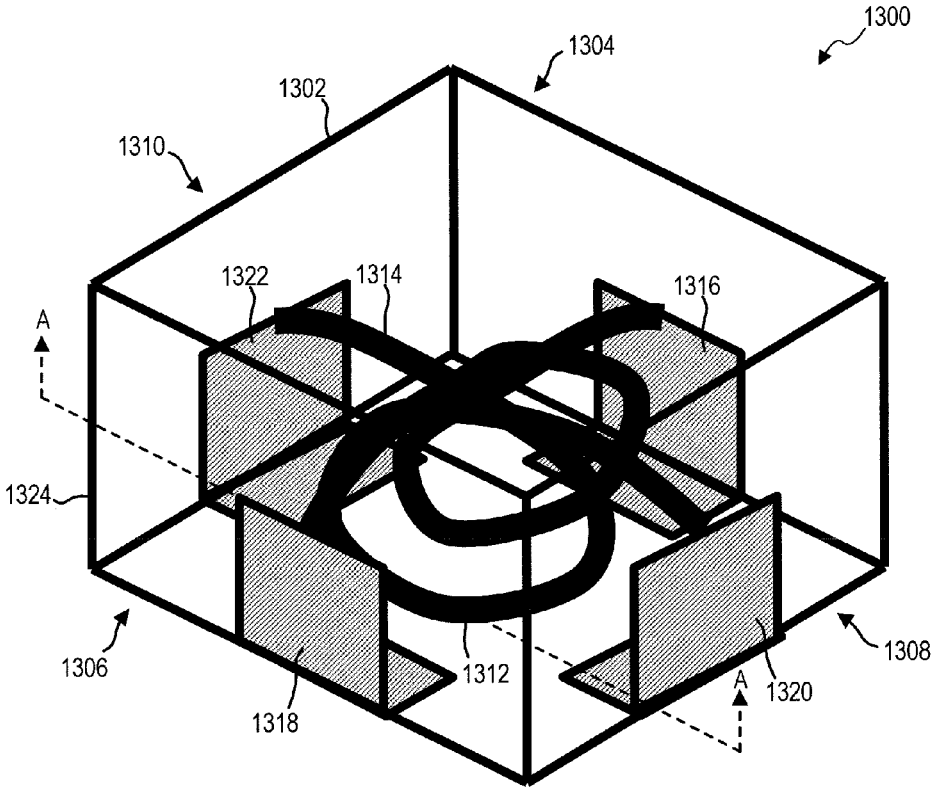
FIG. 13 shows a perspective view and FIG. 14 shows a top cross sectional view of another two phase coupled inductor, according to an embodiment.
Figure 14:
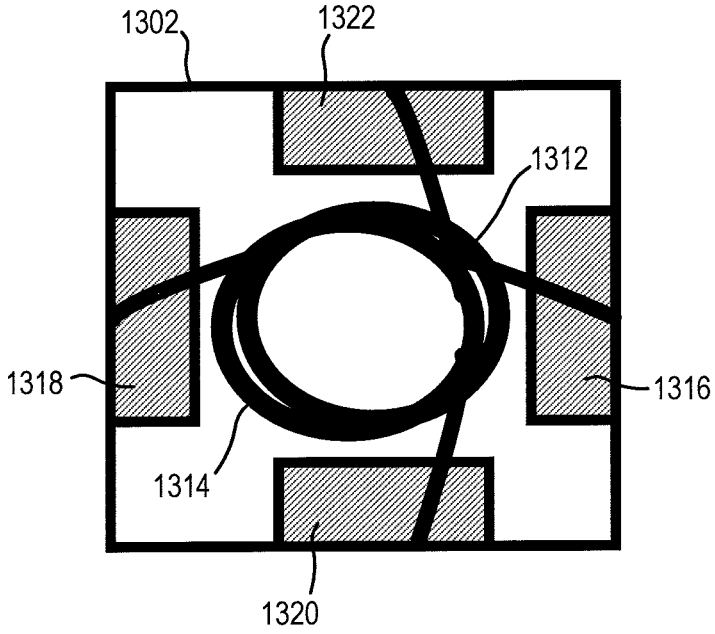

FIGS. 13-14 show yet another variation of coupled inductor 100. Specifically, FIG. 13 shows a perspective view of one coupled inductor 1300, and FIG. 14 shows a cross sectional view of coupled inductor 1300 taken along line A-A of FIG. 13. Coupled inductor 1300 is similar to coupled inductor 100, but includes a different winding configuration. Coupled inductor 1300 includes a core 1302, shown as transparent in FIG. 13, which is formed of a powder magnetic material, such as powdered iron within a binder. Core 1302 includes first side 1304, second side 1306, third side 1308, and fourth side 1310. First side 1304 is opposite of second side 1306, and third side 1308 is opposite of fourth side 1310.

Figure 15:
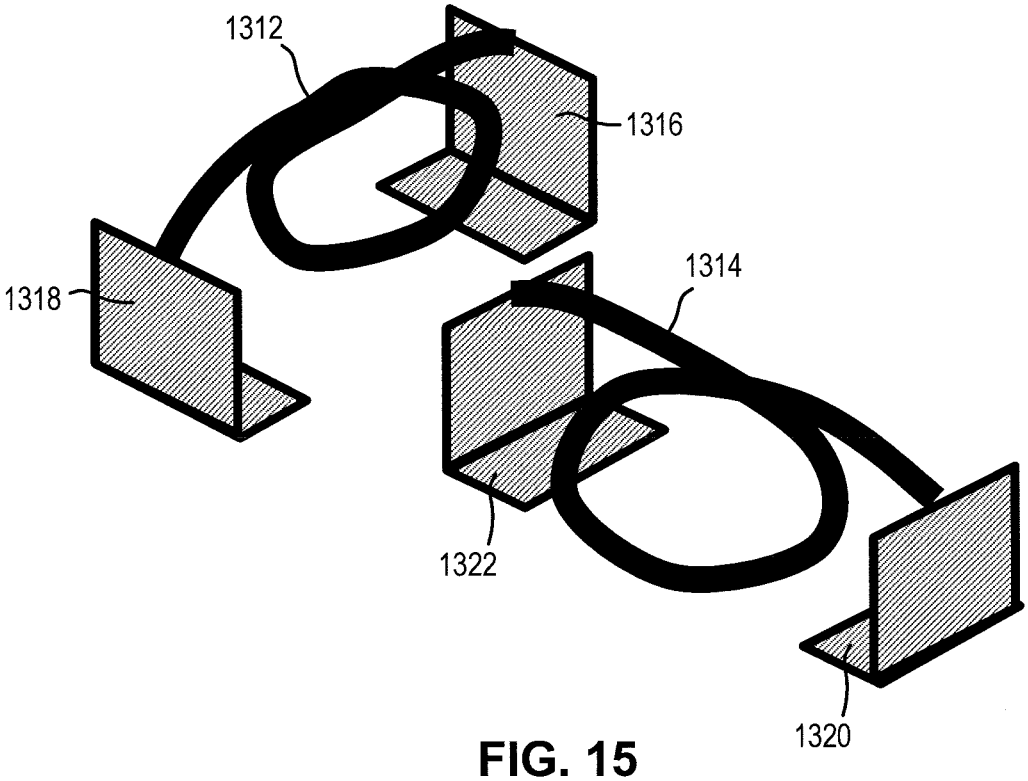
FIG. 15 shows a perspective view of the windings of the coupled inductor of FIGS. 13 and 14 separated from a magnetic core of the inductor.

Coupled inductor 1300 further includes windings 1312, 1314 and electrical terminals 1316, 1318, 1320, 1322. Terminal 1316 is disposed proximate to first side 1304 of core 1302, terminal 1318 is disposed proximate to second side 1306 of core 1302, terminal 1320 is disposed proximate to third side 1308 of core 1302, and terminal 1322 is disposed proximate to fourth side 1310 of core 1302. Winding 1312 is electrically coupled between first and second terminals 1316, 1318, and winding 1314 is electrically coupled between third and fourth terminals 1320, 1322. Windings 1312, 1314 are at least partially embedded in magnetic core 1302, and similar to coupled inductor 1000, windings 1312, 1314 are vertically displaced from each other along a vertical axis 1324. FIG. 15 shows a perspective view of windings 1312, 1314 separated from core 1302.

A current flowing through winding 1312 from first terminal 1316 to second terminal 1318 induces a current in winding 1314 flowing from third terminal 1320 to fourth terminal 1322. Accordingly, inverse magnetic coupling between windings 1312, 1314 in a DC-to-DC converter application can be achieved, for example, with either first and third terminals 1316, 1320, or second and fourth terminals 1318, 1322, electrically coupled to respective switching nodes.

Figure 16:
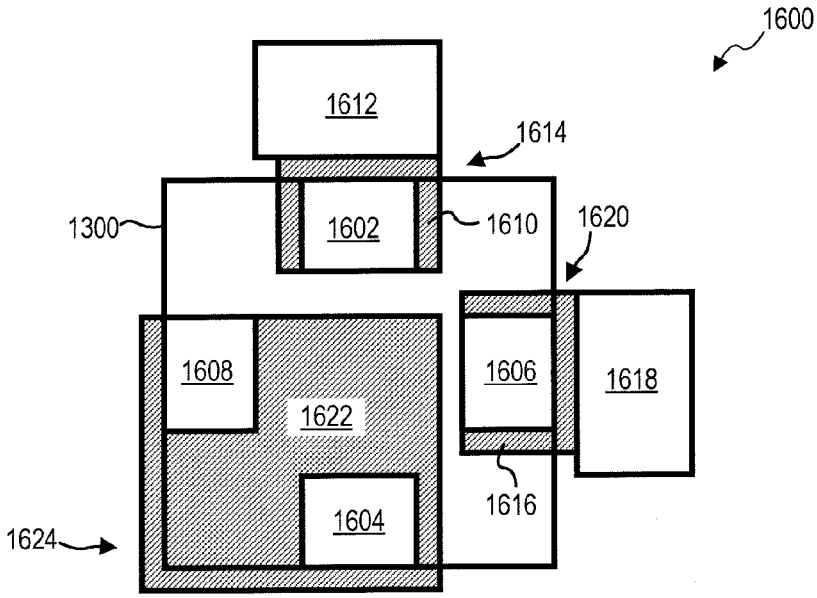
FIG. 16 shows one printed circuit board layout that may be used with certain embodiments of the coupled inductor of FIGS. 13 and 14 in a DC-to-DC converter application.

For example, FIG. 16 shows one PCB layout 1600, which is one example of a PCB layout that may be used with certain embodiments of coupled inductor 1300 in a DC-to-DC converter application. Layout 1600 includes pads 1602, 1604, 1606, 1608 for respectively coupling to terminals 1316, 1318, 1320, 1322 of coupled inductor 1300. Only the outline of coupled inductor 1300 is shown in FIG. 16 to show the pads of layout 1600. A conductive trace 1610 connects pad 1602 and a switching circuit 1612 to a first switching node 1614, and a conductive trace 1616 connects pad 1606 and a switching circuit 1618 to a second switching node 1620. A conductive trace 1622 connects pads 1604, 1608 to a common node 1624. It should be noted that conductive trace 1622 is short and wide in layout 1600, thereby promoting low impedance on common node 1624. In certain embodiments, layout 1600 forms part of a buck converter where common node 1624 is an output node, and switching circuits 1612, 1618 respectively switch switching nodes 1614, 1620 between an input voltage and ground.

Figure 17:
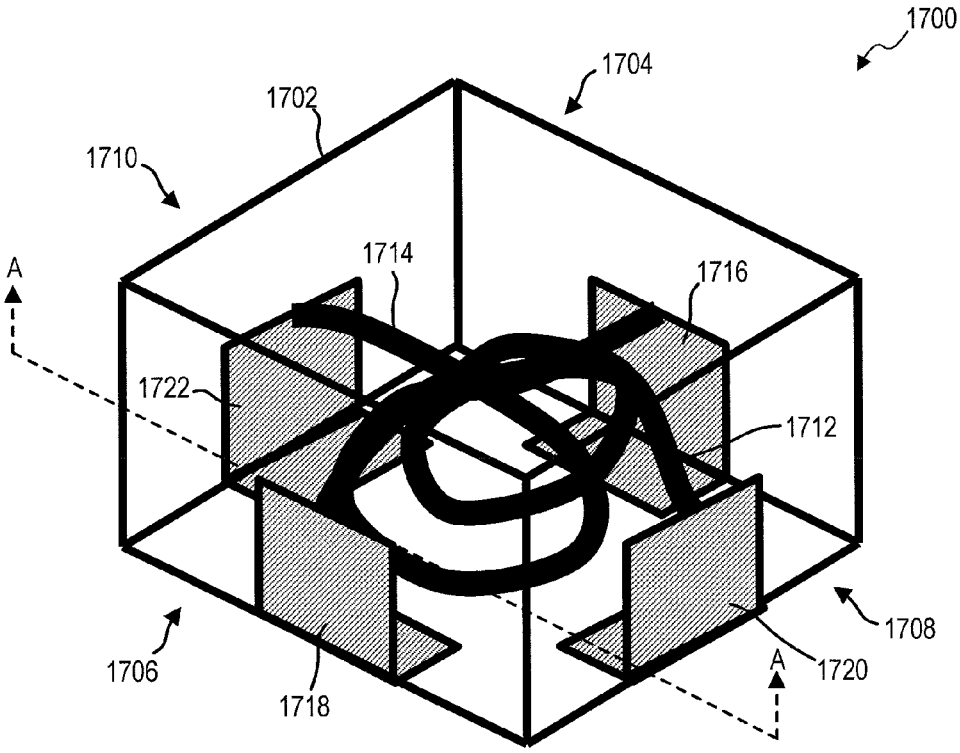
FIG. 17 shows a perspective view and FIG. 18 shows a top cross sectional view of another two phase coupled inductor, according to an embodiment.
Figure 18:
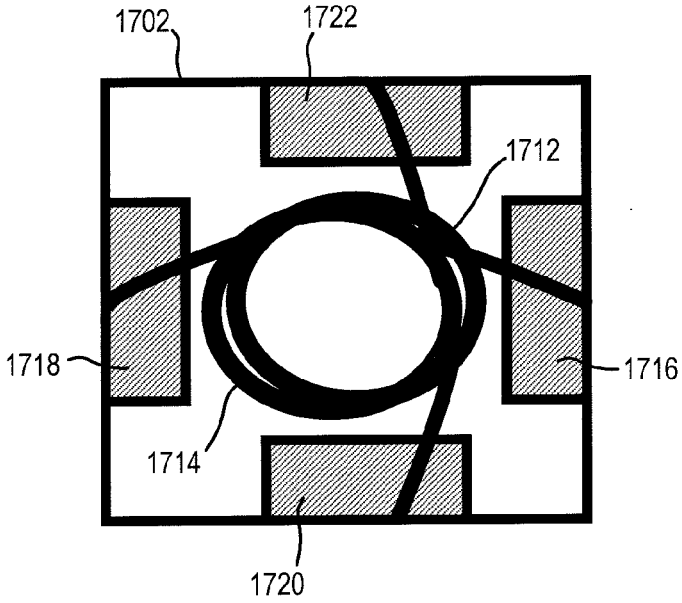

FIG. 17 shows a perspective view of another coupled inductor 1700, and FIG. 18 shows a cross sectional view of inductor 1700 taken along line A-A of FIG. 17. Coupled inductor 1700 is similar to coupled inductor 1300 of FIG. 13, but with a different winding configuration. Coupled inductor 1700 includes a magnetic core 1702 formed of a powder magnetic material, such as powdered iron within a binder. Core 1702 is shown as transparent in FIG. 17, and core 1702 includes a first side 1704, a second side 1706, a third side 1708, and a fourth side 1710.

Figure 19:
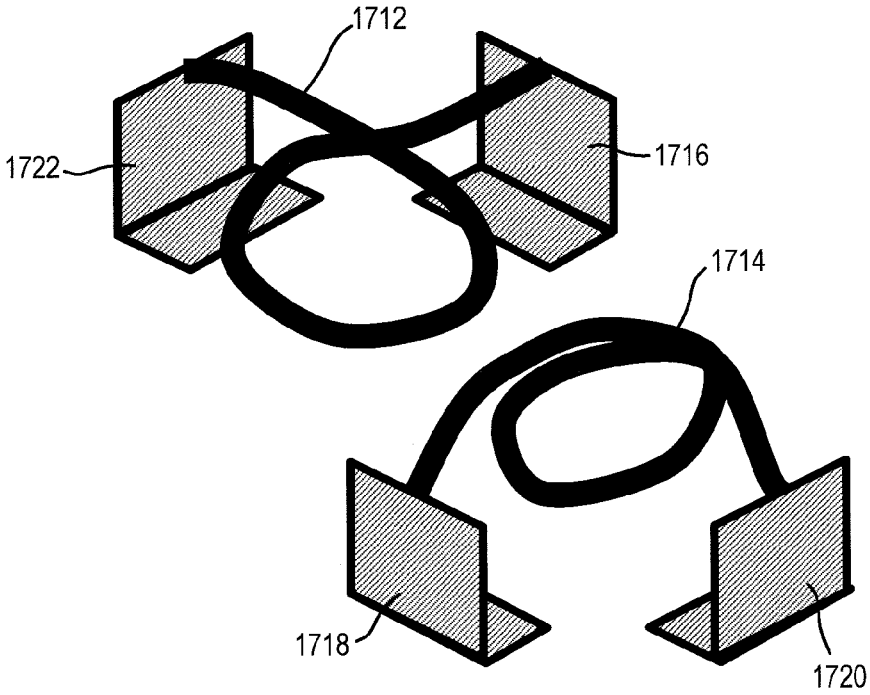
FIG. 19 shows a perspective view of the windings of the coupled inductor of FIGS. 17 and 18 separated from a magnetic core of the inductor.

Coupled inductor 1700 further includes windings 1712, 1714, and terminals 1716, 1718, 1720, 1722. Terminal 1716 is disposed proximate to first side 1704, terminal 1718 is disposed proximate to second side 1706, terminal 1720 is disposed proximate to third side 1708, and terminal 1722 is disposed proximate to fourth side 1710. Winding 1712 is electrically coupled between first and fourth terminals 1716, 1722, and winding 1714 is electrically coupled between second and third terminals 1718, 1720. FIG. 19 shows a perspective view of windings 1712, 1714 separated from core 1702.

An electric current flowing through winding 1712 from fourth terminal 1722 to first terminal 1716 induces a current flowing through winding 1714 flowing from third terminal 1720 to second terminal 1718. Accordingly, inverse magnetic coupling is achieved in DC-to-DC converter applications when either first and second terminals 1716, 1718 or third and fourth terminals 1720, 1722 are electrically coupled to respective switching nodes.

Figure 20:
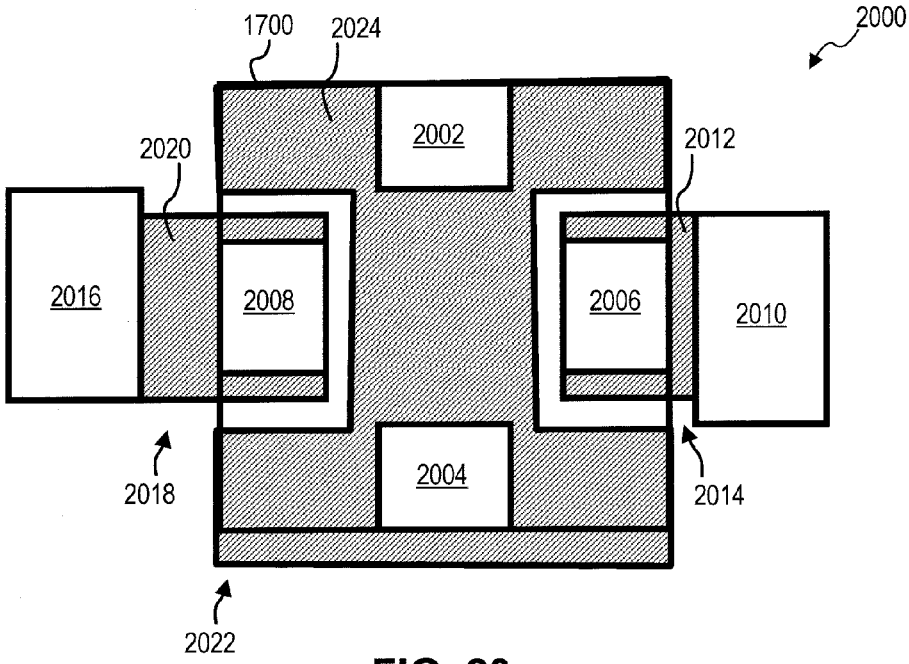
FIG. 20 shows one printed circuit board layout that may be used with certain embodiments of the coupled inductor of FIGS. 17 and 18 in a DC-to-DC converter application.

FIG. 20 shows one layout 2000 that may be used with certain embodiments of coupled inductor 1700 in a DC-to-DC converter application. Layout 2000 includes first, second, third, and fourth solder pads 2002, 2004, 2006, 2008 for respectively coupling to terminals 1716, 1718, 1720, 1722 of coupled inductor 1700. Pad 2006 and a switching circuit 2010 connect to first switching node 2012 via a conductive trace 2014, and pad 2008 and a second switching circuit 2016 connect to a second switching node 2018 via a conductive trace 2020. Pads 2002, 2004 are electrically coupled to common output node 2022 via a conductive trace 2024. Only the outline of coupled inductor 1700 is shown in FIG. 20 to show the pads of layout 2000.

Figure 21:
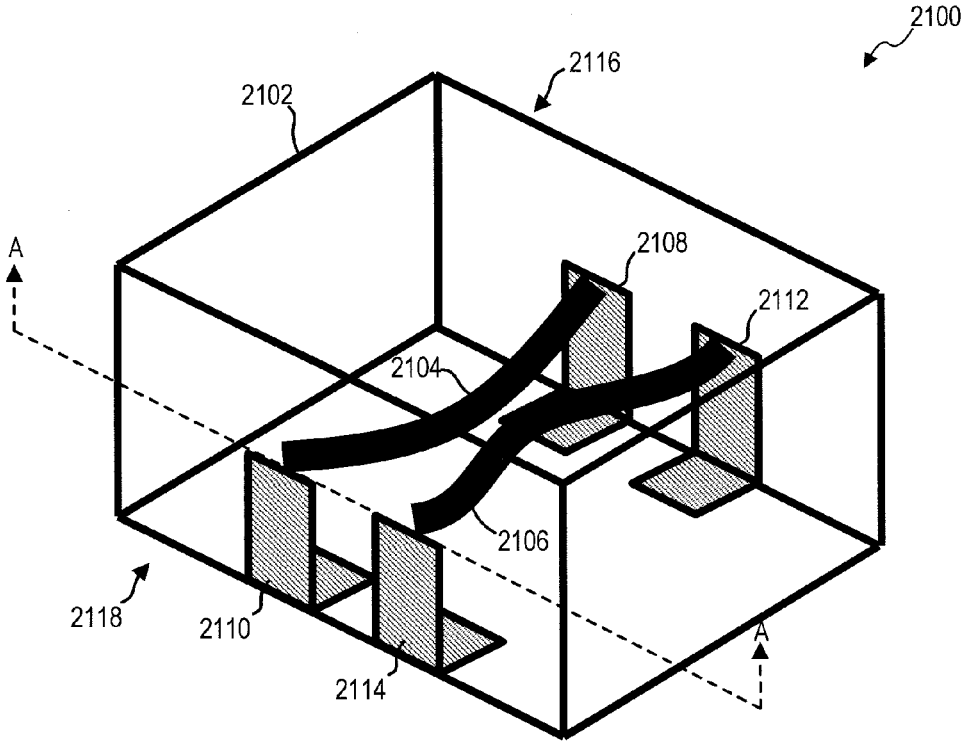
FIG. 21 shows a perspective view and FIG. 22 shows a top cross sectional view of another two phase coupled inductor, according to an embodiment.
Figure 22:
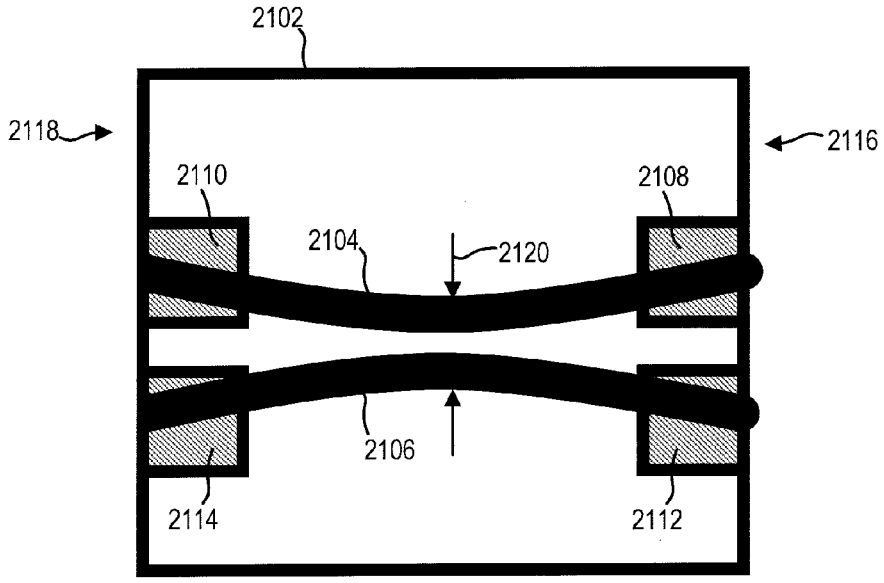

FIG. 21 shows a perspective view of one coupled inductor 2100, and FIG. 22 shows a top plan view of coupled inductor 2100 taken along line A-A of FIG. 21. Coupled inductor is similar to coupled inductor 100 (FIG. 1), but includes "staple" style windings. Coupled inductor 2100 includes a magnetic core 2102 (shown as transparent in FIG. 21) formed of a powder magnetic material, such as powdered iron within a binder, staple style windings 2104, 2106, and electrical terminals 2108, 2110, 2112, 2114. Terminals 2108, 2112 are disposed proximate to a first side 2116 of core 2102, and terminals 2110, 2114 are disposed proximate to an opposite second side 2118 of core 2102. Winding 2104 is electrically coupled between terminals 2108, 2110, and winding 2106 is electrically coupled between terminals 2112, 2114.

Windings 2104, 2106 are configured in core 2102 such that an electric current flowing through winding 2104 from a first terminal 2108 to second terminal 2110 induces an electric current in winding 2106 flowing from fourth terminal 2114 to third terminal 2112. Accordingly, inverse magnetic coupling is achieved with coupled inductor 2100 when terminals on opposite sides 2116, 2118 of core 2102 are connected to respective switching nodes. Thus, certain embodiments of coupled inductor 2100 may be used with PCB layout 500 (FIG. 5).

Leakage inductance associated with windings 2104, 2106 increases as spacing 2120 between windings 2104, 2106 increases (see FIG. 22). Accordingly, leakage inductance can be varied during the design of coupled inductor 2100 merely by varying spacing 2120, which promotes ease manufacturing of embodiments of coupled inductor 2100 having different leakage inductance values. In contrast, some conventional coupled inductors require a change in core geometry and/or a change in gap thickness to vary leakage inductance, possibly requiring extensive changes in tooling to vary leakage inductance.

Figure 23:
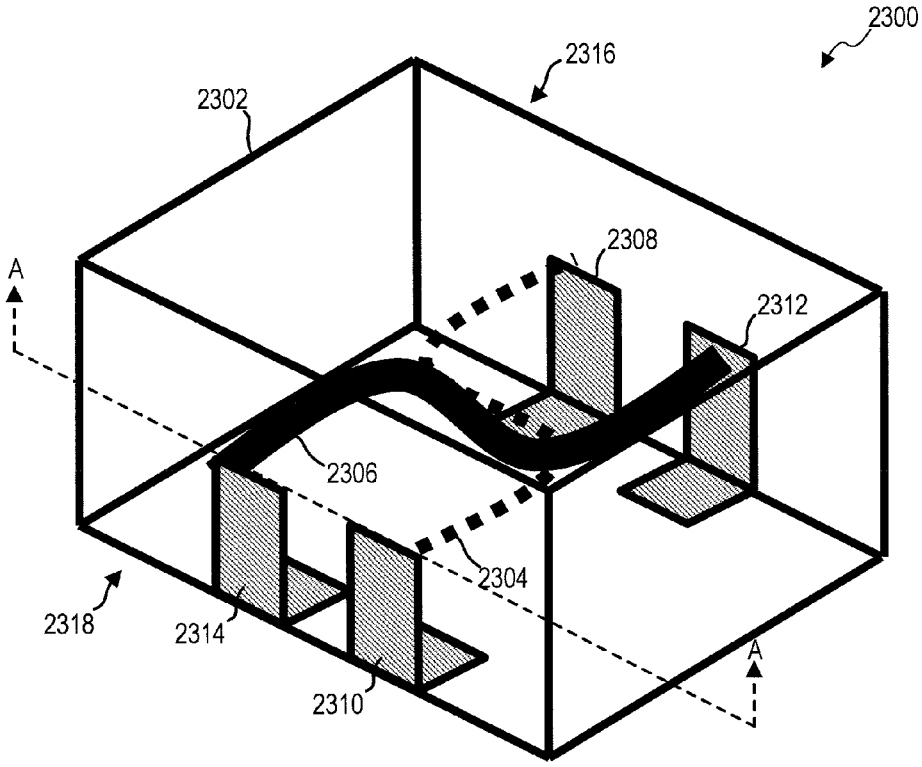
FIG. 23 shows a perspective view and FIG. 24 shows a top cross sectional view of another two phase coupled inductor, according to an embodiment.
Figure 24:
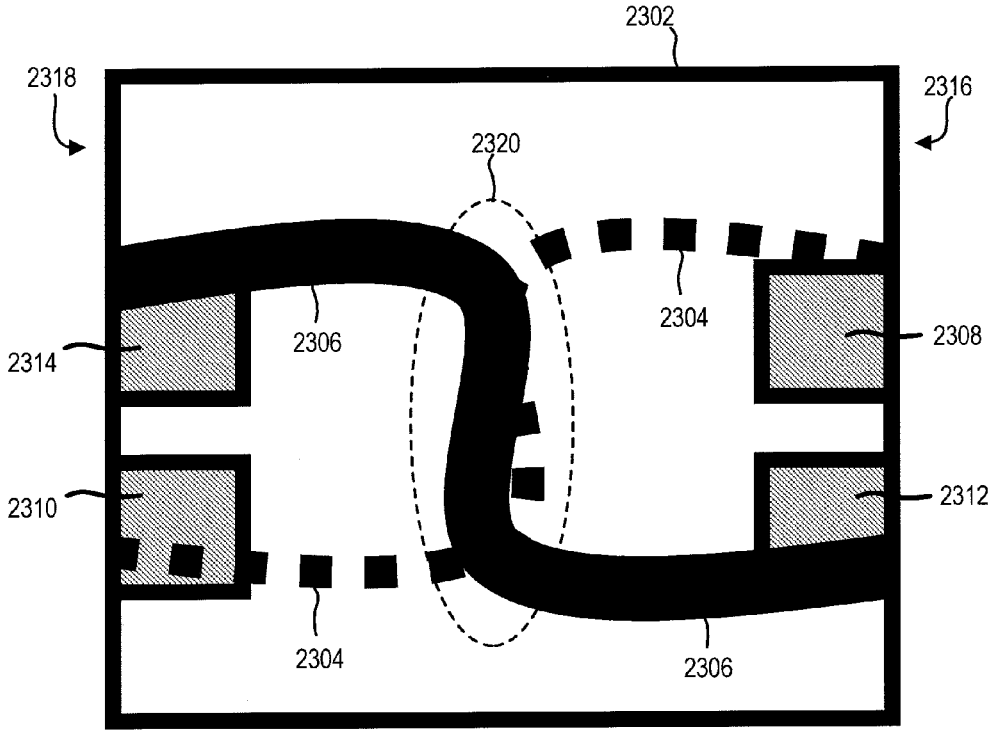

FIG. 23 shows a perspective view of one coupled inductor 2300, and FIG. 24 shows a top plan view of coupled inductor 2300 taken along line A-A of FIG. 23. Coupled inductor 2300 includes a core 2302, shown as transparent in FIG. 23, formed of a powder magnetic material, such as powdered iron within a binder. Coupled inductor 2300 further includes windings 2304, 2306 at least partially embedded in core 2302 and electrical terminals 2308, 2310, 2312, and 2314. Winding 2304 is electrically coupled between terminals 2308, 2310, and winding 2306 is electrically coupled between terminals 2312, 2314. Winding 2304 is shown as a dashed line in FIGS. 23 and 24 for illustrative purposes (i.e., to assist in distinguishing between windings 2304, 2306 in the figures). In actuality, winding 2304 is typically formed of the same material as winding 2306. Windings 2304, 2306 cross each other in magnetic core 2302. Terminals 2308, 2312 are disposed proximate to a first side 2316 of core 2302, and terminals 2310, 2314 are disposed proximate to a second side 2318 of core 2302.

Portions 2320 of windings 2304, 2306 are aligned with each other (e.g., at least partially vertically overlap each other) so that windings 2304, 2306 are magnetically coupled (see FIG. 24). The more windings 2304, 2306 are aligned with each other, the greater will be the magnetizing inductance of coupled inductor 2300. Accordingly, magnetizing inductance can be varied during the design of coupled inductor by varying the extent to which windings 2304, 2306 are aligned with each other.

Portions of windings 2304, 2306 that are not aligned with each other contribute to leakage inductance associated with windings 2304, 2306. Accordingly, leakage inductance can be varied during the design of coupled inductor 2300 by varying the extent to which windings 2304, 2306 are not aligned with each other as well as spacing between windings.

Windings 2304, 2306 are configured in core 2302 such that a current flowing through winding 2304 from first terminal 2308 to second terminal 2310 induces a current through winding 2306 from third terminal 2312 to fourth terminal 2314. Thus, inverse magnetic coupling is achieved with coupled inductor 2300 when either terminals 2308, 2312 or 2310, 2314 are electrically coupled to respective switching nodes. Accordingly, certain embodiments of coupled inductor 2300 can be used with layout 900 of FIG. 9.

Figure 25:
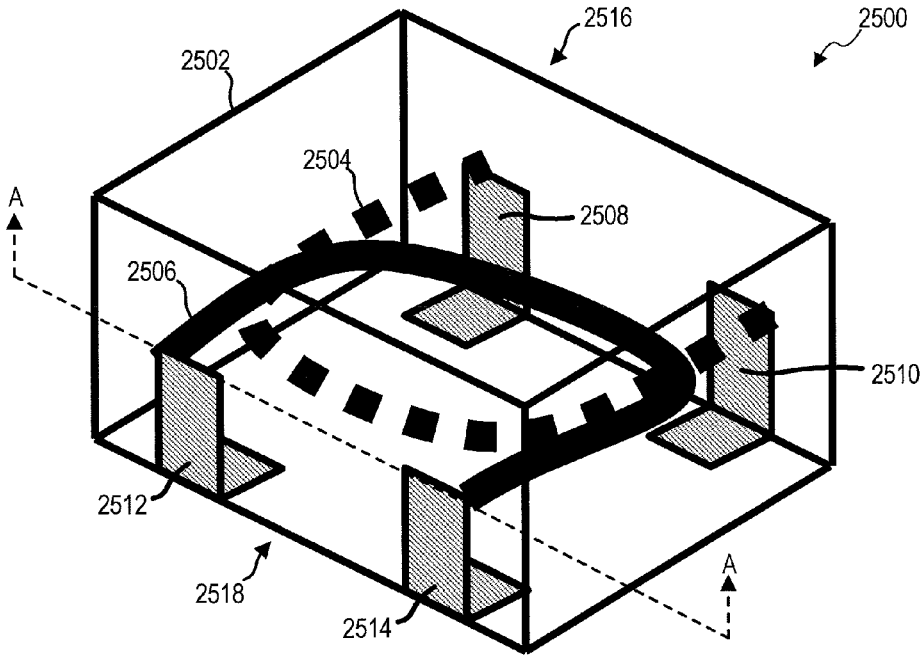
FIG. 25 shows a perspective view and FIG. 26 shows a top cross sectional view of another two phase coupled inductor, according to an embodiment.
Figure 26:
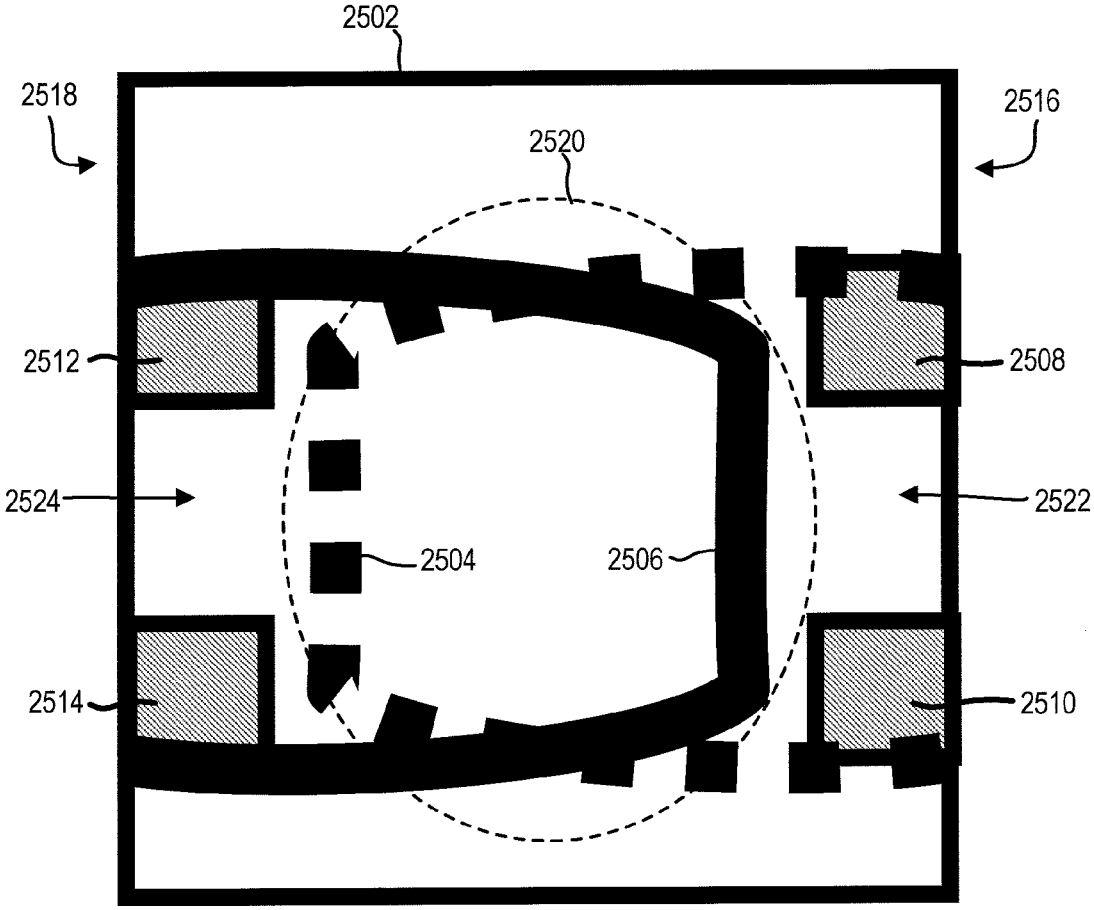

FIG. 25 shows a perspective view of one coupled inductor 2500, and FIG. 26 shows a top plan view of coupled inductor 2500 taken along line A-A of FIG. 25. Coupled inductor 2500 includes a core 2502, shown as transparent in FIG. 25, formed of a powder magnetic material, such as powdered iron within a binder. Coupled inductor 2500 further includes windings 2504, 2506 at least partially embedded in core 2502 and electrical terminals 2508, 2510, 2512, and 2514. Winding 2504 is electrically coupled between terminals 2508, 2510, and winding 2506 is electrically coupled between terminals 2512, 2514. Winding 2504 is shown as a dashed line in FIGS. 25 and 26 for illustrative purposes (i.e., to assist in distinguishing between windings 2504, 2506 in the figures). In actuality, winding 2504 is typically formed of the same material as winding 2506. Terminals 2508, 2510 are disposed proximate to a first side 2516 of core 2502, and terminals 2512, 2514 are disposed proximate to a second side 2518 of core 2502.

Center portions 2520 of windings 2504, 2506 are aligned with each other so that windings 2504, 2506 are magnetically coupled. The more windings 2504, 2506 are aligned with each other, the greater will the magnetizing inductance of coupled inductor 2500. Accordingly, magnetizing inductance can be varied during the design of coupled inductor 2500 by varying the extent to which windings 2504, 2506 are aligned with each other.

Portions of windings 2504, 2506 that are not aligned with each other contributed to leakage inductance associated with windings 2504, 2506. Accordingly, leakage inductance can be varied during the design of coupled inductor 2500 by varying the extent to which windings 2504, 2506 are not aligned with each other.

It should also be noted that coupled inductor 2500 can be configured during its design to have asymmetric leakage inductance values—that is, so that the respective leakage inductance values associated with windings 2504, 2506 are different. Coupled inductor 2500 includes core portions 2522, 2524, which are shown as having the same size in FIG. 26. Portion 2522 represents a portion of core 2502 bounded by winding 2504 but outside of center portion 2520. Similarly, portion 2524 represents a portion of core 2502 bounded by winding 2506 but outside of center portion 2520. Since portions 2522, 2524 have the same size, the respective leakage inductance values associated with windings 2504, 2506 are approximately equal. However, if couple inductor 2500 is modified such that portions 2522, 2524 have different sizes, coupled inductor will have asymmetric leakage inductance values. For example, if portion 2522 is made larger than portion 2524, the leakage inductance value associated with winding 2504 will be larger than the leakage inductance value associated with winding 2506.

Windings 2504, 5506 are configured in core 2502 such that a current flowing through winding 2504 from first terminal 2508 to second terminal 2510 induces a current through winding 2506 flowing from third terminal 2512 to fourth terminal 2514. Thus, inverse magnetic coupling is achieved with coupled inductor 2500 in DC-to-DC converter applications when either terminals 2508, 2512 or 2510, 2514 are electrically coupled to respective switching nodes.

Figure 27:
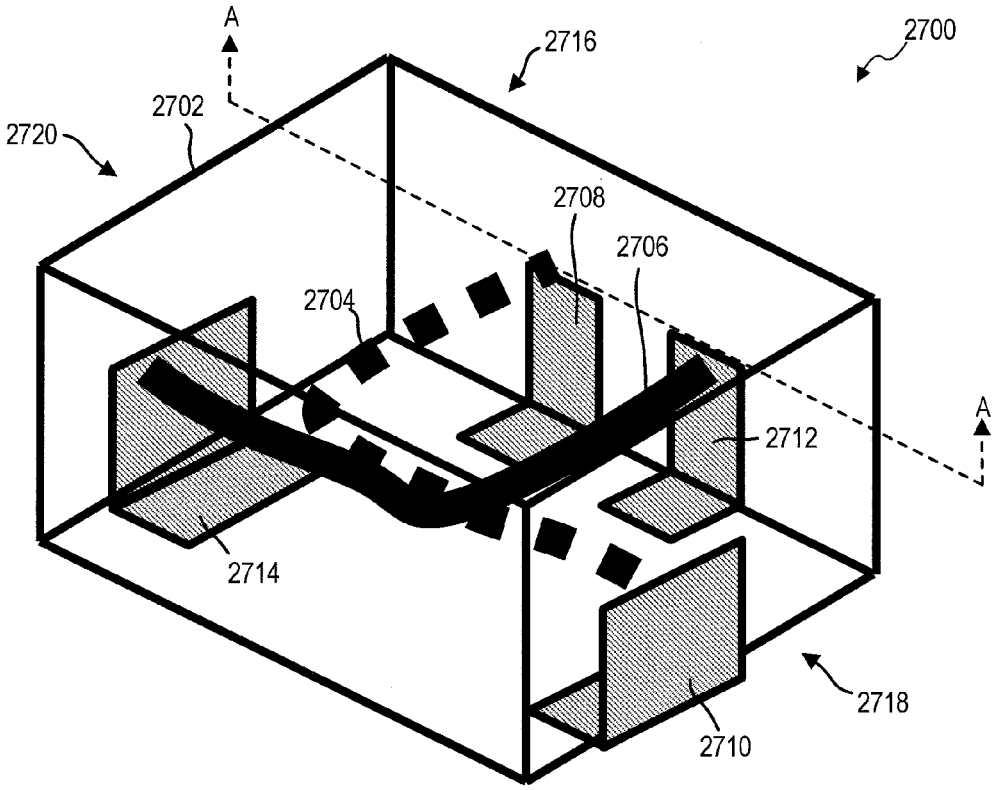
FIG. 27 shows a perspective view and FIG. 28 shows a top cross sectional view of another two phase coupled inductor, according to an embodiment.
Figure 28:
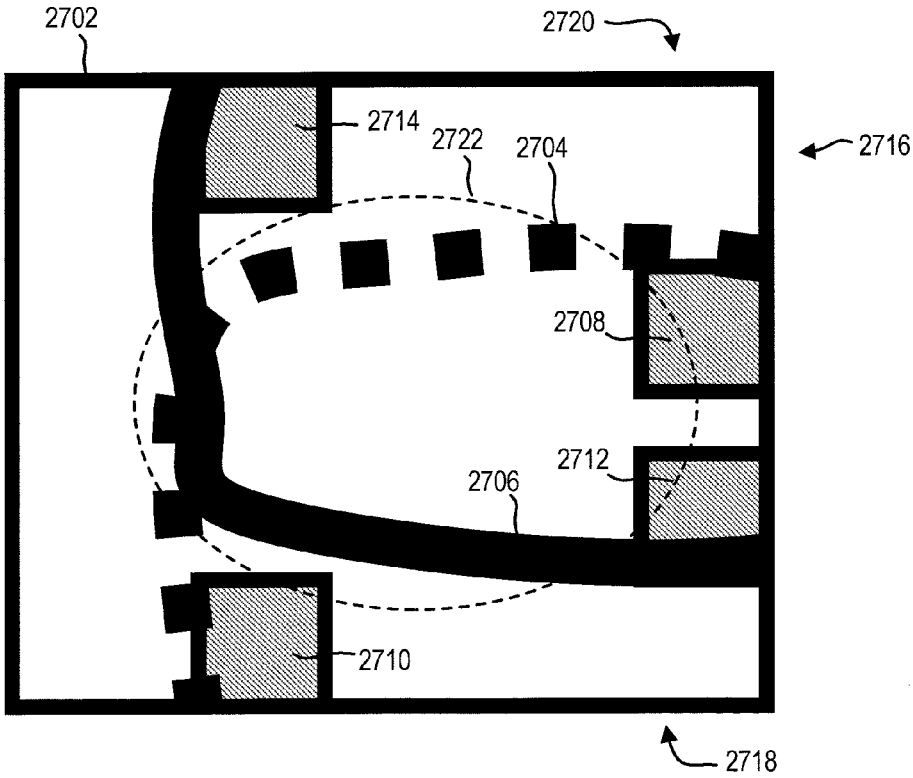

FIG. 27 shows a perspective view of one coupled inductor 2700, and FIG. 28 shows a top plan view of coupled inductor 2700 taken along line A-A of FIG. 27. Coupled inductor 2700 includes a core 2702, shown as transparent in FIG. 27, and formed of a powder magnetic material, such as powdered iron within a binder. Coupled inductor 2700 further includes windings 2704, 2706 at least partially embedded in core 2702 and electrical terminals 2708, 2710, 2712, and 2714. Winding 2704 is electrically coupled between terminals 2708, 2710, and winding 2706 is electrically coupled between terminals 2712, 2714. Winding 2704 is shown as a dashed line in FIGS. 27 and 28 for illustrative purposes (i.e., to assist in distinguishing between windings 2704, 2706 in the figures). In actuality, winding 2704 is typically formed of the same material as winding 2706. Windings 2704, 2706 cross each other in magnetic core 2702. Terminals 2708, 2712 are disposed proximate to a first side 2716 of core 2702, terminal 2710 is disposed proximate to a second side 2718 of core 2702, and terminal 2714 is disposed proximate to a third side 2720 of core 2702. As shown in FIG. 27, second side 2718 is opposite to third side 2720, and first side 2716 is disposed between second and third sides 2718, 2720.

Center portions 2722 of windings 2704, 2706 are aligned with each other so that windings 2704, 2706 are magnetically coupled. The more windings 2704, 2706 are aligned with each other, the greater will the magnetizing inductance of coupled inductor 2700. Accordingly, magnetizing inductance can be varied during the design of coupled inductor 2700 by varying the extent to which windings 2704, 2706 are aligned with each other.

Portions of windings 2704, 2706 that are not aligned with each other contributed to leakage inductance associated with windings 2704, 2706. Accordingly, leakage inductance can be varied during the design of coupled inductor 2700 by varying the extent to which windings 2704, 2706 are not aligned with each other.

Windings 2704, 2706 are configured in core 2702 such that a current flowing through winding 2704 from first terminal 2708 to second terminal 2710 induces a current through winding 2706 flowing from third terminal 2712 to fourth terminal 2714. Thus, inverse magnetic coupling is achieved with coupled inductor 2700 in DC-to-DC converter applications when either terminals 2708, 2712 or 2710, 2714 are electrically coupled to respective switching nodes.

Figure 29:
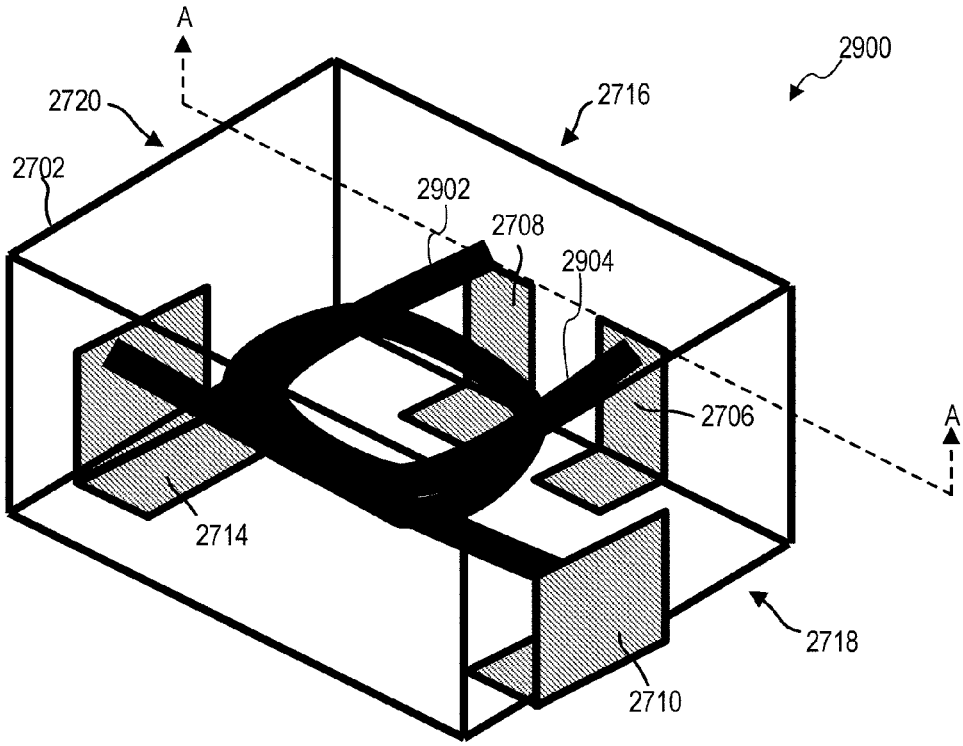
FIG. 29 shows a perspective view and FIG. 30 shows a top cross sectional view of another two phase coupled inductor, according to an embodiment.
Figure 30:
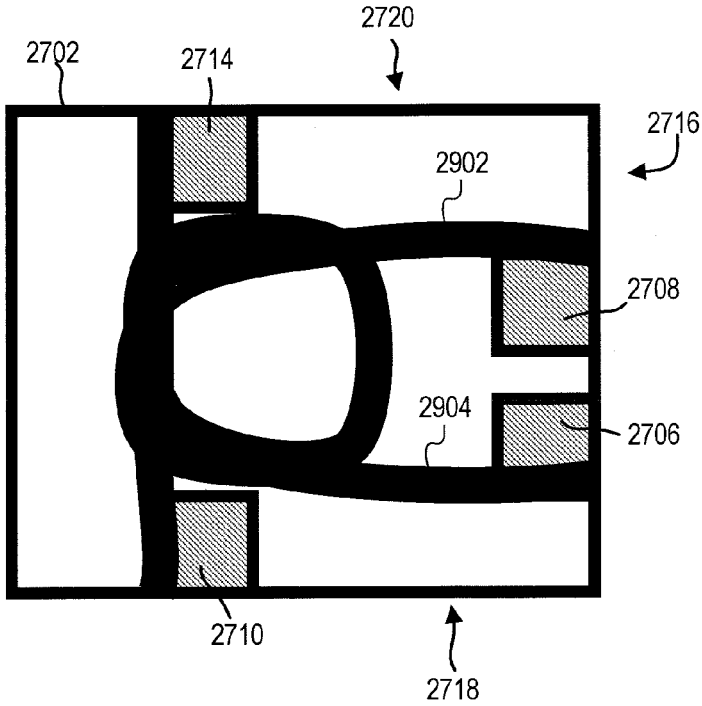
Figure 31:
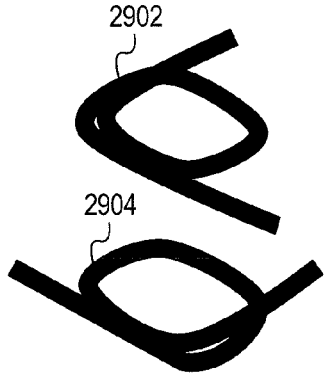
FIG. 31 shows a perspective view of the windings of the coupled inductor of FIGS. 29 and 30.

FIG. 29 shows a perspective view of one coupled inductor 2900, and FIG. 30 shows a top plan view of coupled inductor 2900 taken along line A-A of FIG. 29. Coupled inductor 2900 is similar to coupled inductor 2700 (FIG. 27), but includes windings 2902, 2904 forming one or more complete turns, instead of windings 2704, 2706. FIG. 31 shows a perspective view of windings 2902, 2904 separated from themselves and from coupled inductor 2900. Although coupled inductor 2900 is shown with windings 2902, 2904 forming about one and a half complete turns, one or more windings 2902, 2904 may form more turns (e.g., about two and a half turns).

Use of windings forming multiple turns increases magnetic coupling between the windings, thereby increasing magnetizing inductance, which may be beneficial in switching power converter applications. For example, in a multi-phase DC-to-DC converter using a coupled inductor, increasing magnetizing inductance typically decreases ripple current in the inductors and the switches. Alternately, increasing the number of turns may enable core material permeability to be decreased while still maintaining a desired magnetizing inductance value, thereby reducing magnetic flux in the core and associated core losses.

Figure 32:
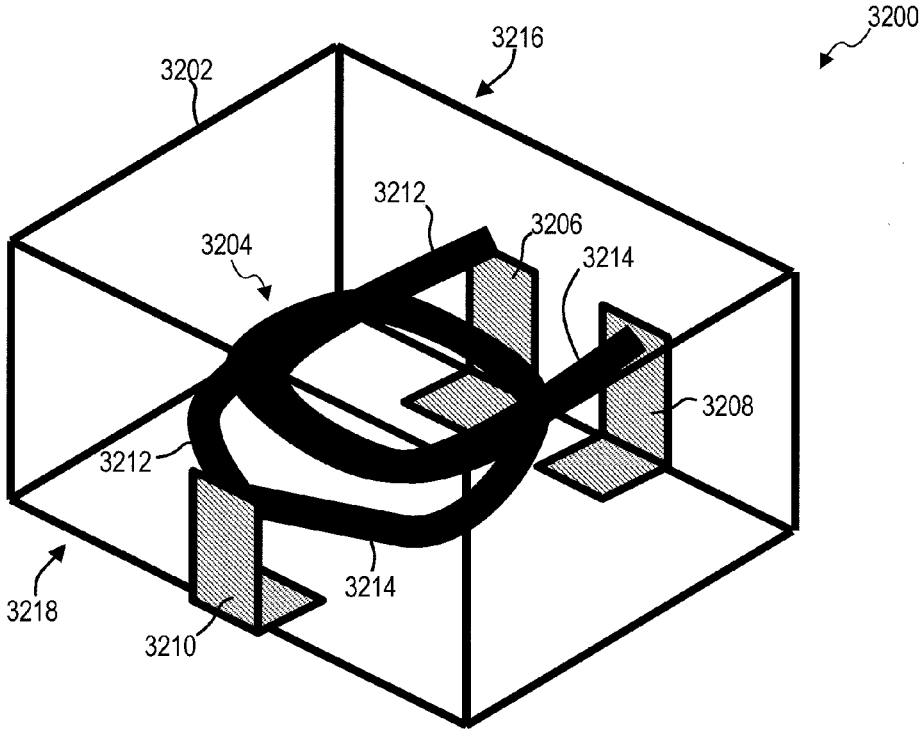
FIG. 32 shows a perspective view and FIG. 33 shows a top cross sectional view of another two phase coupled inductor, according to an embodiment.
Figure 33:
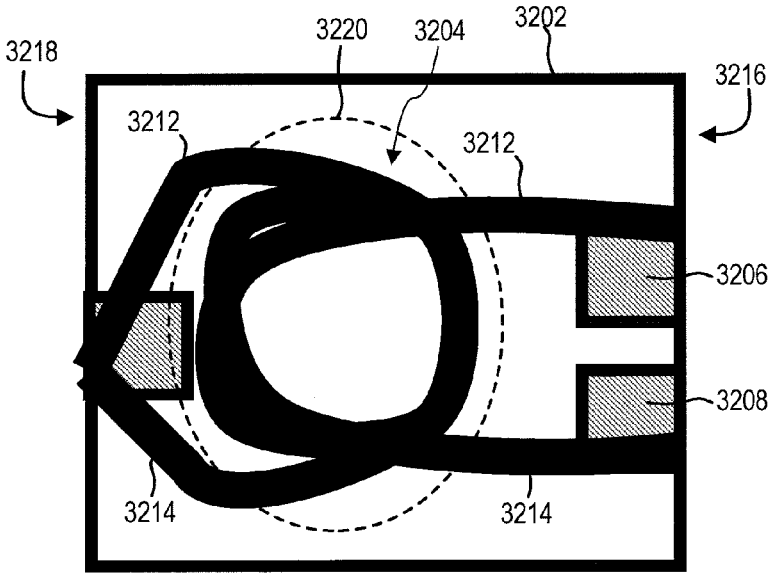
Figure 34:
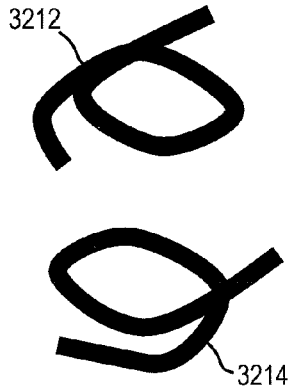
FIG. 34 shows a perspective view of the windings of the coupled inductor of FIGS. 32 and 33.

FIG. 32 shows a perspective view of one coupled inductor 3200, and FIG. 33 shows a top plan view of coupled inductor 3200 taken along line A-A of FIG. 32. Coupled inductor 3200 includes a core 3202, shown as transparent in FIG. 32, formed of a powder magnetic material, such as powdered iron within a binder. Coupled inductor 3200 further includes windings 3212, 3214 at least partially embedded in core 3202 and electrical terminals 3206, 3208, and 3210. Winding 3212 is electrically coupled between terminals 3206, 3210, while winding 3214 is electrically between terminals 3208, 3210. In certain embodiments, windings 3212, 3214 are formed from a common piece of wire 3204 that is coupled along its length to terminal 3210. In certain embodiments where windings 3212, 3214 are part of a common wire 3204, a portion of wire 3204 is flattened to form terminal 3210. FIG. 34 shows a perspective view of windings 3212, 3214 separated from themselves and from coupled inductor 3200. Terminals 3206, 3208 are disposed proximate to a first side 3216 of core 3202, and terminal 3210 is disposed proximate to a second side 3218 of core 3202.

Central portions 3220 of windings 3212, 3214 are aligned with each other so that windings 3212, 3214 are magnetically coupled. Portions of windings 3212, 3214 that are not aligned with each other contribute to leakage inductance associated with windings 3212, 3214. The number of turns formed by windings 3212, 3214 and/or the shape of windings 3212, 3214 can be varied during the design of coupled inductor 3200 to control leakage inductance and/or magnetizing inductance. For example, windings 3212, 3214 could be modified to form additional turns or not turns at all. Increasing the portions of windings 3212, 3214 that are aligned increases magnetizing inductance, and increasing portions of windings 3212, 3214 that are not aligned increases leakage inductance.

As discussed above, in certain embodiments, windings 3212, 3214 are formed from a common wire. Such configuration promotes low cost of coupled inductor 3200, since it is typically cheaper and/or easier to manufacture a single winding inductor that a multiple winding inductor. Additionally, the fact that both of windings 3212, 3214 are connected to a common terminal 3210 may promote precise relative positioning of windings 3212, 3214, thereby promoting tight leakage and magnetizing inductance tolerance.

Windings 3212, 3214 are configured in core 3202 such that a current flowing through winding 3212 from first terminal 3206 to third terminal 3210 induces a current through winding 3214 flowing from second terminal 3208 to third terminal 3210. Thus, inverse magnetic coupling is achieved with coupled inductor 3200 in DC-to-DC converter applications when terminals 3206, 3208 are electrically coupled to respective switching nodes.

Certain embodiments of the powder magnetic core coupled inductors disclosed herein may have one or more desirable characteristics. For example, because the windings of the coupled inductors are at least partially embedded in a magnetic core, they do not necessarily need to be wound through a passageway of a magnetic core, thereby promoting low cost and manufacturability, particularly in embodiments with multiple turns per winding, and/or complex shaped windings. As another example, certain embodiments of the coupled inductors disclosed herein may be particularly mechanically robust because their windings are embedded in, and thereby protected by, the magnetic core. In yet another exemplary embodiment, leakage inductance of certain embodiments of the coupled inductors disclosed herein can be adjusted during the design stage merely by adjusting a separation between windings in the magnetic core.

Although some of the examples above show one turn per winding, it is anticipated that certain alternate embodiments of the coupled inductors discussed herein will form two or more turns per winding. Additionally, although windings are electrically isolated from each other within the magnetic cores in most of the examples discussed above, in certain alternate embodiments, two or more windings are electrically coupled together, or ends of two or more windings are connected to a single terminal. Such alternate embodiments may be useful in applications where respective ends of two or more windings are connected to a common node (e.g., a buck converter output node or a boost converter input node). For example, in an alternate embodiment of coupled inductor 600 (FIG. 6), winding 604 is electrically coupled between first and second terminals 608, 610, winding 606 is electrically coupled between third and second terminals 612, 610, and fourth terminal 614 may be eliminated. Furthermore, as discussed above, the configurations of the electrical terminals can be varied (e.g., solder tabs may be replaced with through-hole pins).

As discussed above, one example of a powder core magnetic material that may be used to form the cores of the coupled inductors disclosed herein is iron within a binder. However, it is anticipated that in certain embodiments, another magnetic material, such as nickel, cobalt, and/or alloys of rare earth metals, will be used in place of or in addition to iron. In some embodiments, the magnetic material is alloyed with other magnetic and/or nonmagnetic elements. For example, in certain embodiments, the powder core magnetic material includes an alloy of iron within a binder, such as iron alloyed with cobalt, carbon, nickel, and/or molybdenum within a binder.

In certain embodiments, the powder core magnetic material includes a moldable binder, such that the magnetic core may be cured in a mold to form a "molded" magnetic core. Examples of moldable binders include polymers, such thermoplastic or thermosetting materials.

It should be appreciated that the powder magnetic material magnetic cores discussed above are monolithic (i.e., single unit) magnetic cores, in contrast to magnetic cores formed of a number of discrete magnetic elements.

Figure 35:
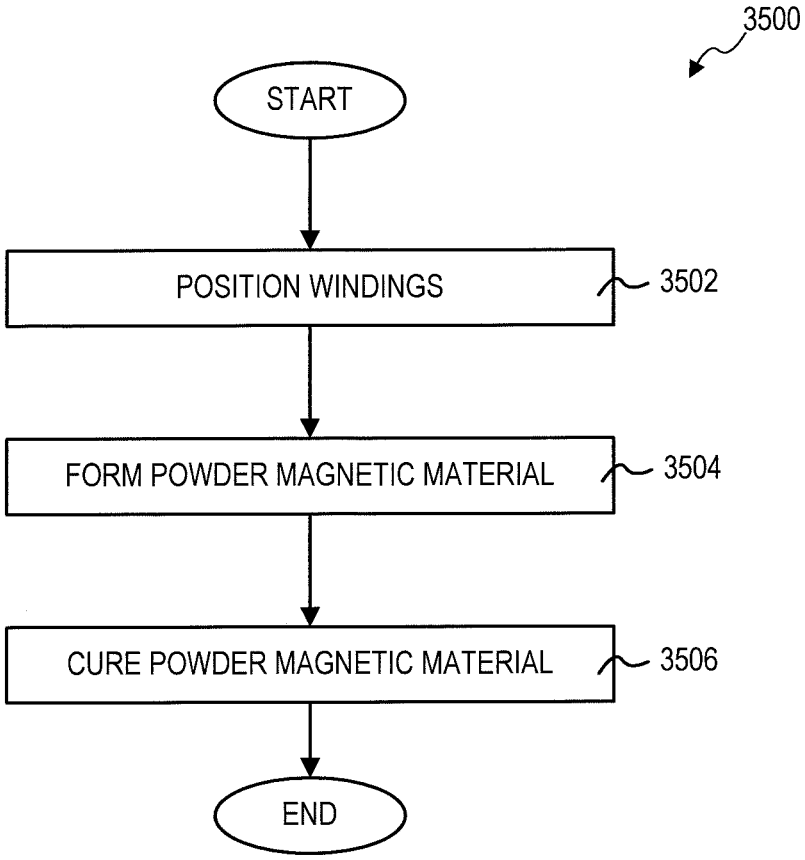
FIG. 35 illustrates a method for forming a multiphase coupled inductor, according to an embodiment.

FIG. 35 illustrates a method 3500 for forming powder magnetic core coupled inductors. Method 3500 may be used to form certain embodiments of the coupled inductors discussed above. However, method 3500 is not limited to forming such embodiments, and the embodiments discussed above may be formed by methods other than method 3500.

Method 3500 includes step 3502 of positioning a plurality of windings such that each of the plurality of windings is at least partially physically separated from each other of the plurality of windings. An example of step 3502 is positioning windings 104, 106 of FIG. 1 such that they are separate from each other. Another example of step 3502 is positioning windings 104, 106 in a mold such that they are at least partially physically separated from each other. The windings are, for example, completely physically separated and/or aligned to form at least one turn around a common axis, such as shown in FIG. 1. In step 3504, a powder magnetic material is formed at least partially around the plurality of windings positioned in step 3502. An example of step 3504 is forming a powder magnetic material including powdered iron or a similar magnetic powder within a binder around windings 104, 106 of FIG. 1. Another example of step 3504 is disposing a powder magnetic material including a moldable binder in a mold in which windings 104, 106 are positioned. In step 3506, the binder of the powder magnetic material formed in step 3504 is cured (e.g., heated, subjected to pressure, and/or subjected to one or more chemicals), thereby forming a monolithic magnetic core with windings embedded therein. An example of step 3506 is sintering the powder magnetic material formed around windings 104, 106 of FIG. 1 to form magnetic core 102. Another example of step 3506 is curing via a chemical reaction a composite material including powdered magnetic material combined with an epoxy or a thermosetting binder disposed in a mold around windings 104, 106.

As discussed above, one possible use of the coupled inductors disclosed herein is in switching power supplies, such as in switching DC-to-DC converters. Accordingly, the magnetic material used to form the magnetic cores is typically a material that exhibits a relatively low core loss at high switching frequencies (e.g., at least 20 KHz) that are common in switching power supplies.

Figure 36:
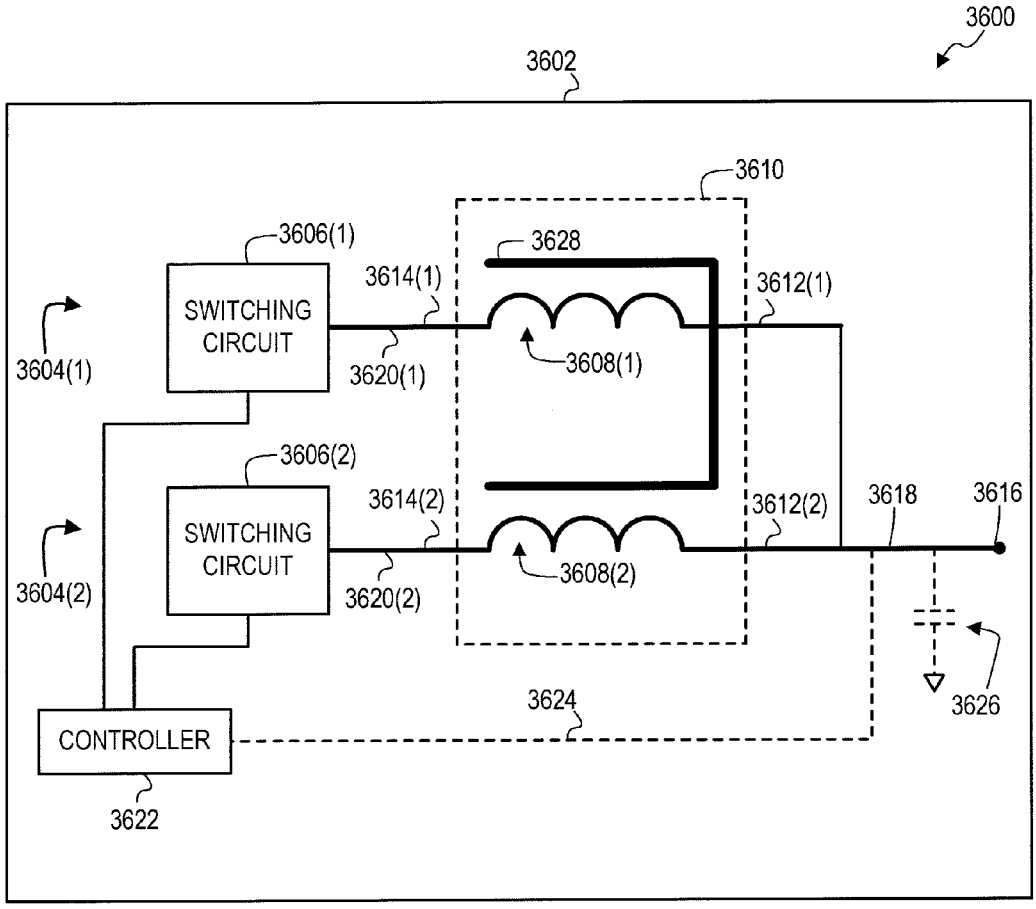
FIG. 36 shows one power supply, according to an embodiment.

FIG. 36 schematically shows one power supply 3600, which is one possible application of the coupled inductors discussed herein. Power supply 3600 includes a PCB 3602 for supporting and electrically connecting components of power supply 3600. PCB 3602 could alternately be replaced with a number of separate, but electrically interconnected, PCBs.

Power supply 3600 is shown as including two phases 3604, where each phase includes a respective switching circuit 3606 and a winding 3608 of a two-phase coupled inductor 3610. However, alternative embodiments of power supply 3600 may have a different number of phases 3604, such as four phases, where a first pair of phases utilizes windings of a first two-phase coupled inductor, and a second pair of phases utilizes windings of a second two-phase coupled inductor. Examples of two-phase coupled inductor 3610 include coupled inductor 100 (FIG. 1), coupled inductor 600 (FIG. 6), coupled inductor 1000 (FIG. 10), coupled inductor 1300 (FIG. 13), coupled inductor 1700 (FIG. 17), coupled inductor 2100 (FIG. 21), coupled inductor 2300 (FIG. 23), coupled inductor 2500 (FIG. 25), coupled inductor 2700 (FIG. 27), coupled inductor 2900 (FIG. 29), and coupled inductor 3200 (FIG. 32).

Each winding 3608 has a respective first end 3612 and a respective second end 3614. First and second ends 3612, 3614, for example, form surface mount solder tabs suitable for surface mount soldering to PCB 3602. For example, in an embodiment where coupled inductor 3610 is an embodiment of coupled inductor 100 (FIG. 1), first end 3612(1) represents terminal 110, second end 3614(1) represents terminal 108, first end 3612(2) represents terminal 112, and second end 3614(2) represents terminal 114. Each first end 3612 is electrically connected to a common first node 3616, such as via a PCB trace 3618.

Each second end 3614 is electrically connected to a respective switching circuit 3606, such as by a respective PCB trace 3620. Switching circuits 3606 are configured to switch second end 3614 of their respective winding 3608 between at least two different voltage levels. Controller 3622 controls switching circuits 3606, and controller 3622 optionally includes a feedback connection 3624, such as to first node 3616. First node 3616 optionally includes a filter 3626.

Power supply 3600 typically has a switching frequency, the frequency at which switching circuits 3606 switch, of at least about 20 kHz, such that sound resulting from switching is above a frequency range perceivable by humans. Operating switching power supply 3600 at a high switching frequency (e.g., at least 20 kHz) instead of at a lower switching frequency may also offer advantages such as (1) an ability to use smaller energy storage components (e.g., coupled inductor 3610 and filter capacitors), (2) smaller ripple current and ripple voltage magnitude, and/or (3) faster converter transient response. To enable efficient operation at high switching frequencies, the one or more magnetic materials forming a magnetic core 3628 of coupled inductor 3610 are typically materials having relatively low core losses at high frequency operation.

In some embodiments, controller 3622 controls switching circuits 3606 such that each switching circuit 3606 operates out of phase from each other switching circuit 3606. Stated differently, in such embodiments, the switched waveform provided by each switching circuit 3606 to its respective second end 3614 is phase shifted with respect to the switched waveform provided by each other switching circuit 3606 to its respective second end 3614. For example, in certain embodiments of power supply 3600, switching circuit 3606(1) provides a switched waveform to second end 3614(1) that is about 180 degrees out of phase with a switched waveform provided by switching circuit 3606(2) to second end 3614(2).

In embodiments where power supply 3600 is a DC-to-DC converter, it utilizes, for example, one of the PCB layouts discussed above, such as PCB layout 500 (FIG. 5), 900 (FIG. 9), 1600 (FIG. 16), or 2000 (FIG. 20). For example, if power supply 3600 is a DC-to-DC converter using inductor 600 with PCB layout 900, switching circuits 914, 916 of layout 900 correspond to switching circuits 3606(1), 3606(2) of power supply 3600, and switching traces 918, 920 of layout 900 correspond to traces 3620(1), 3620(2) of power supply 2200.

Power supply 3600 can be configured to have a variety of configurations. For example, switching circuits 3606 may switch their respective second ends 3614 between an input voltage node (not shown) and ground, such that power supply 3600 is configured as a buck converter, first node 3616 is an output voltage node, and filter 3626 is an output filter. In this example, each switching circuit 3606 includes at least one high side switching device and at least one catch diode, or at least one high side switching device and at least one low side switching device. In the context of this document, a switching device includes, but is not limited to, a bipolar junction transistor, a field effect transistor (e.g., a N-channel or P-channel metal oxide semiconductor field effect transistor, a junction field effect transistor, or a metal semiconductor field effect transistor), an insulated gate bipolar junction transistor, a thyristor, or a silicon controlled rectifier.

In another exemplary embodiment, power supply 3600 is configured as a boost converter such that first node 3616 is an input power node, and switching circuits 3606 switch their respective second end 3614 between an output voltage node (not shown) and ground. Additionally, power supply 3600 can be configured, for example, as a buck-boost converter such that first node 3616 is a common node, and switching circuits 3606 switch their respective second end 3614 between an output voltage node (not shown) and an input voltage node (not shown).

Furthermore, in yet another example, power supply 3600 may form an isolated topology. For example, each switching circuit 3606 may include a transformer, at least one switching device electrically coupled to the transformer's primary winding, and a rectification circuit coupled between the transformer's secondary winding and the switching circuit's respective second end 3614. The rectification circuit optionally includes at least one switching device to improve efficiency by avoiding forward conduction voltage drops common in diodes.

Changes may be made in the above methods and systems without departing from the scope hereof. For example, although the above examples of coupled inductors show a rectangular shaped core, core shape could be varied. As another example, the number of windings per inductor and/or the number of turns per winding could be varied. It should thus be noted that the matter contained in the above description and shown in the accompanying drawings should be interpreted as illustrative and not in a limiting sense. The following claims are intended to cover generic and specific features described herein, as well as all statements of the scope of the present method and system, which, as a matter of language, might be said to fall therebetween

What is claimed is:

1. A coupled inductor, comprising:

a monolithic magnetic core formed of a powder magnetic material;

first, second, third, and fourth terminals;

a first winding at least partially embedded in the monolithic magnetic core, the first winding electrically coupled between the first and second terminals; and a second winding at least partially embedded in the monolithic magnetic core, the second winding electrically coupled between the third and fourth terminals, the second winding at least partially physically separated from the first winding within the monolithic magnetic core;

wherein:

the powder magnetic material comprises a moldable binder, the second and fourth terminals are part of a common terminal, the first and third terminals are disposed proximate to a first side of the monolithic magnetic core, and the common terminal is disposed proximate to a second side of the monolithic magnetic core, the second side being opposite to the first side, and the first and second windings are configured such than an electric current flowing through the first winding from the first terminal to the common terminal induces an electric current flowing through the second winding from the third terminal to the common terminal.

2. The coupled inductor of claim 1, wherein the powder magnetic material comprises iron.

3. The coupled inductor of claim 1, each of the first, second, third, and fourth terminals comprising an element selected from the group consisting of a solder tab and a through-hole pin.

4. The coupled inductor of claim 1, wherein:

the first winding forms at least one complete turn in the monolithic magnetic core; and the second winding forms at least one complete turn in the monolithic magnetic core.

* * * * *

UNITED STATES PATENT AND TRADEMARK OFFICE

CERTIFICATE OF CORRECTION

PATENT NO. : 8,416,043 B2
APPLICATION NO. : 13/024280
DATED : April 9, 2013
INVENTOR(S) : Alexandr Ikriannikov It is certified that error appears in the above-identified patent and that said Letters Patent is hereby corrected as shown below:

In the Specification

Column 3, Line 30, “It the following disclosure,” should read --In the following disclosure,--.
Column 4, Line 33, “power core magnetic material” should read --powder core magnetic material--.
Column 4, Line 63, “configured such at” should read --configured such that--.
Column 5, Line 10, “As result,” should read --As a result,--.
Column 5, Line 39, “as know in the art,” should read --as known in the art,--.
Column 12, Line 2, “that a multiple winding inductor” should read --than a multiple winding inductor--.
Column 12, Line 66 and 67, “such thermoplastic” should read --such as thermoplastic--.

In the Claims

In Claim 1, Column 16, Line 20, “configured such than” should read --configured such that--.

Signed and Sealed this
Thirtieth Day of December, 2014

Michelle K. Lee

Michelle K. Lee
*Deputy Director of the United States Patent and Trademark Office*